US008794703B2

(12) United States Patent
Bateman et al.

(10) Patent No.: US 8,794,703 B2
(45) Date of Patent: Aug. 5, 2014

(54) ADJUSTABLE FOLDING CHAIR FOR EXTENDED PERIODS OF SEATING

(76) Inventors: Allan Bateman, New York, NY (US); Cathie Capobianco, New York, NY (US)

( * ) Notice: Subject to any disclaimer, the term of this patent is extended or adjusted under 35 U.S.C. 154(b) by 276 days.

(21) Appl. No.: 13/209,409

(22) Filed: Aug. 14, 2011

(65) Prior Publication Data

US 2011/0298263 A1 Dec. 8, 2011

Related U.S. Application Data

(63) Continuation-in-part of application No. 12/117,058, filed on May 8, 2008, now abandoned, which is a continuation of application No. 11/689,861, filed on Mar. 22, 2007, now abandoned.

(60) Provisional application No. 60/786,049, filed on Mar. 27, 2006, provisional application No. 60/872,591, filed on Dec. 4, 2006, provisional application No. 61/401,545, filed on Aug. 16, 2010.

(51) Int. Cl.
*A47C 3/40* (2006.01)

(52) U.S. Cl.
USPC ..... 297/344.18; 297/19; 297/29; 297/55; 297/353

(58) Field of Classification Search
USPC ..... 297/19, 20, 25, 29, 344.18; 108/147.21
See application file for complete search history.

(56) References Cited

U.S. PATENT DOCUMENTS

| | | | | | |
|---|---|---|---|---|---|
| 1,713,034 | A * | 5/1929 | Denson et al. | ..... | 297/344.18 |
| 2,037,634 | A * | 4/1936 | Klazkin | ..... | 297/338 |
| 3,856,352 | A * | 12/1974 | Jacobi, Sr. | ..... | 297/423.15 |
| 5,246,265 | A * | 9/1993 | Nagan et al. | ..... | 297/54 |
| 5,667,274 | A * | 9/1997 | Blackman | ..... | 297/338 |
| 6,131,992 | A * | 10/2000 | Chang | ..... | 297/58 |
| 6,296,313 | B1 * | 10/2001 | Wu | ..... | 297/411.35 |
| 6,851,752 | B2 * | 2/2005 | Asbach | ..... | 297/344.12 |
| D521,262 | S * | 5/2006 | Wood | ..... | D6/368 |
| 7,125,079 | B1 * | 10/2006 | Lee et al. | ..... | 297/353 |
| 7,735,911 | B2 * | 6/2010 | Chen | ..... | 297/16.1 |
| 8,459,741 | B2 * | 6/2013 | Mazzola et al. | ..... | 297/344.18 |

* cited by examiner

*Primary Examiner* — Peter Brown
(74) *Attorney, Agent, or Firm* — Miller Law Group, PLLC

(57) ABSTRACT

An adjustable folding chair is configured to include a central chair portion defining a pair of seat back mounting sections, a pair of front leg mounting sections, a pair of rear leg mounting sections, and a seat surface. A seat back is mounted on the seat back mounting sections for vertical movement to position the seat back at a desired position above the seat. Front and rear leg extensions are mounted on the front and rear leg mounting sections for vertical movement. A locking mechanism is housed in a horizontal strut in the front and rear leg extensions to control the positioning thereof. The locking mechanism includes a pair of opposing spring-biased locking pins and an actuator connected thereto that projects from the strut for engagement by the user. Such a chair construction permits the seat surface to be oriented in a plurality of discrete positions for comfortable utilization.

18 Claims, 19 Drawing Sheets

Fig. 26
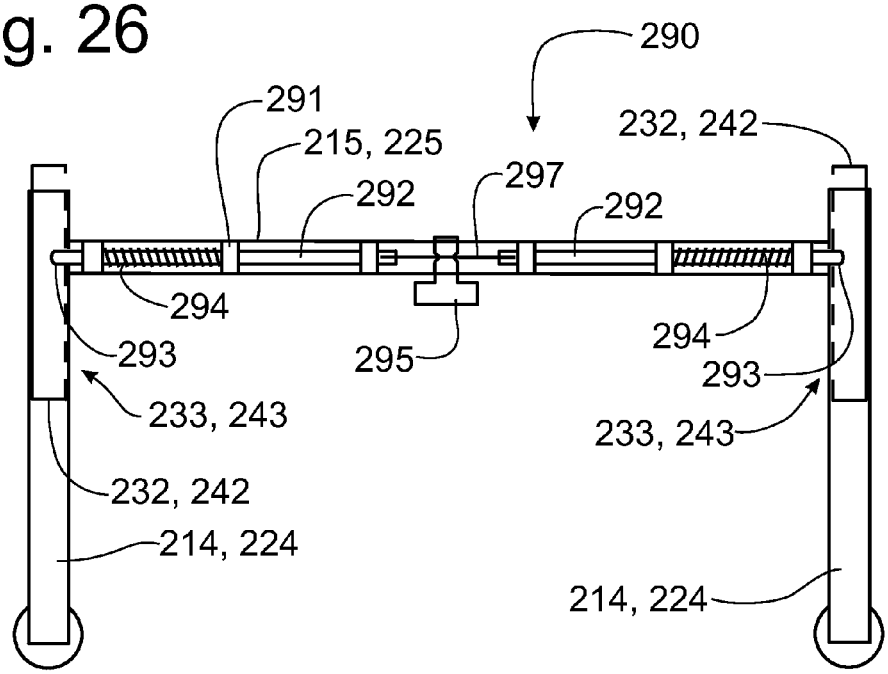
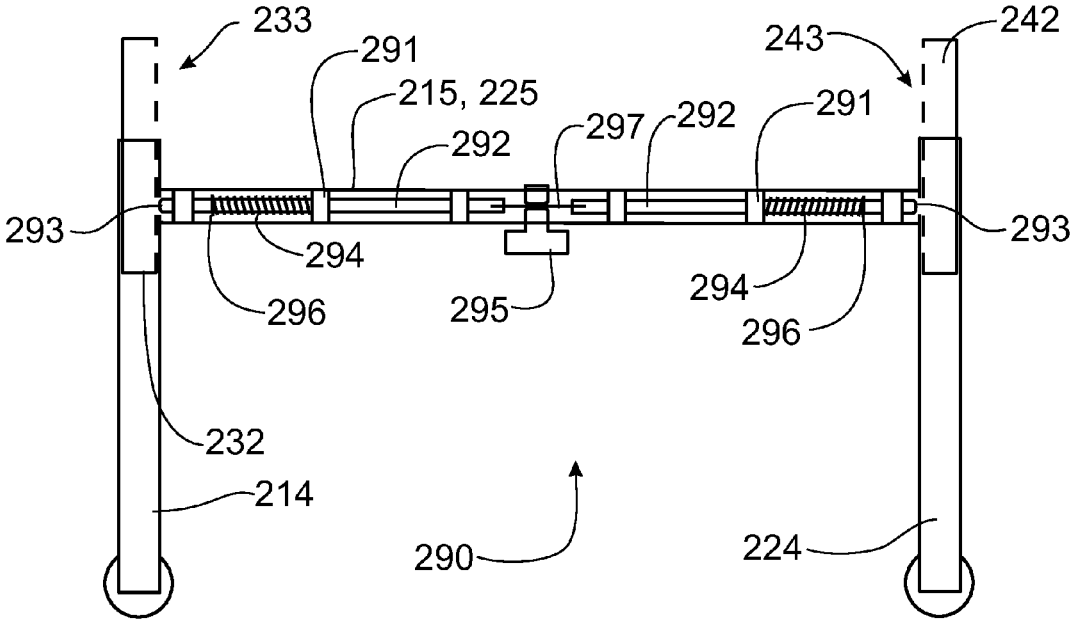
Fig. 27

Fig. 28
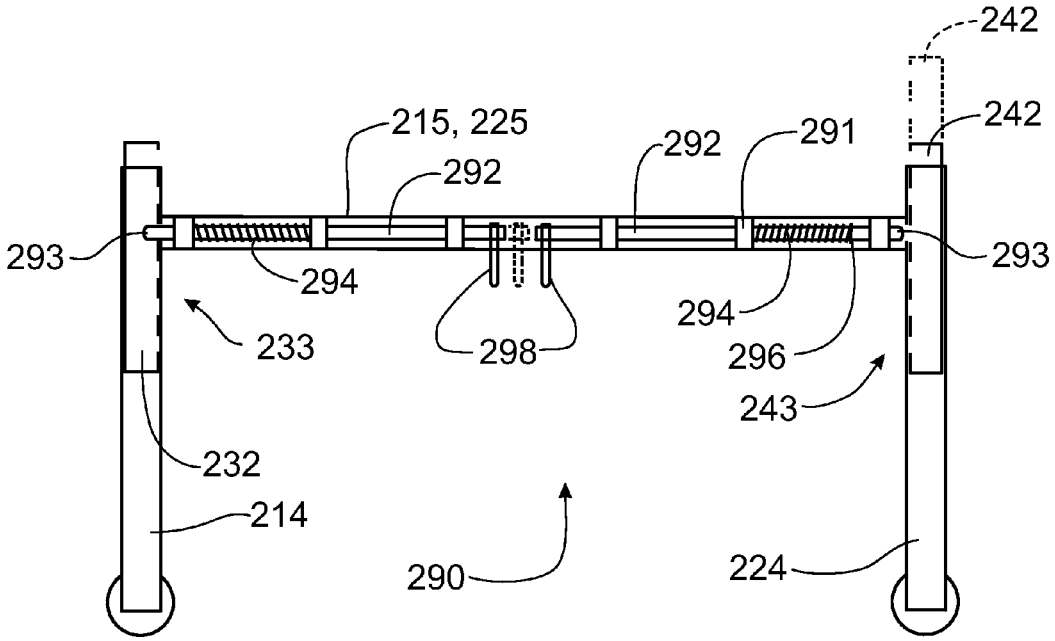
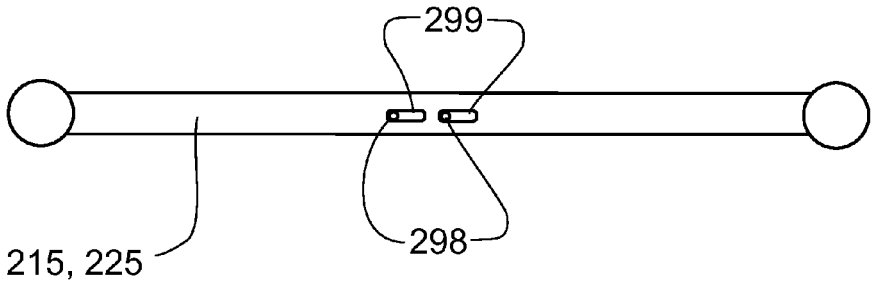
Fig. 29

ADJUSTABLE FOLDING CHAIR FOR EXTENDED PERIODS OF SEATING

CROSS-REFERENCE TO RELATED APPLICATIONS

The present application is a continuation-in-part of U.S. patent application Ser. No. 12/117,058, filed on May 8, 2008, now abandoned which is a continuation of U.S. patent application Ser. No. 11/689,861, filed Mar. 22, 2007, now abandoned which claims domestic priority of U.S. Provisional Patent Application Ser. No. 60/786,049, filed Mar. 27, 2006, and of U.S. Provisional Patent Application Ser. No. 60/872,591, filed Dec. 4, 2006, the disclosures of which are incorporated herein by reference in their entireties. This present application also claims domestic priority on U.S. Provisional Patent Application Ser. No. 61/401,545, filed on Aug. 16, 2010, the content of which is incorporated herein by reference in its entirety.

FIELD OF THE INVENTION

The present invention relates to the configuration of a chair, occasionally referred to as an ALCAT chair in the following description, that facilitates good, relaxed posture and, at the same time, provides adequate total back support when a user is properly seated, as well as certain methods of using such a chair to provide greater comfort during prolonged sitting sessions. The invention is ideal for musicians or other individuals who find it necessary or desirable to remain seated for extended time periods.

Chairs in common use today have a number of basic problems. Typically such a chair includes a solid, full back rest defining, together with a seat surface, a minimal opening at the base of the back rest. Various attempts have been made to improve chair comfort, such as the provision of ergonomic curves providing lumbar and overall back support and curved or scooped out seat surfaces. The user of a chair having such features, however, still typically must exert significant physical effort to sit with good, relaxed, comfortable posture, which is essential if that user is to remain seated for an extended time period. A conventional chair construction tends to force a user to sit on gluteal muscles, impose a backward curve to the spine, and produce a saved-in chest, affecting heart and lung efficiency. Shoulder tension may also affect the arms and hands of a user while seated on a conventionally configured chair, and a rounded lumbar and/or sacral area tends to produces muscle stress and potentially creates possible danger to vertebrae due to possible herniation or exacerbation of other existing conditions.

A conventional chair construction is shown in FIG. 16. When viewed laterally, with "good" sitting posture, a plumb line P perpendicular to the floor F should be aligned with the user's ear, shoulder, hip joint, and ischium, and a line L parallel to the floor at the level of the user's hip joint is preferably slightly higher than the user's knee joint. The user of a conventional chair construction such as that shown in FIG. 16 could have significant difficulty is achieving or maintaining this "good" sitting posture, i.e. a posture considered to provide the most relaxed sitting position, in which the pull of gravity on the user's body and associated stresses produced due to misalignment are minimized. As it is difficult for the user to keep his or her torso in an essentially upright or perpendicular position relative to the seat surface, a relatively large body area is subjected to the force of gravity. If a chair such as that shown in FIG. 16 has a scooped or rounded seat surface and a minimally open space between the backrest and the seat surface, such problems could be amplified.

SUMMARY OF THE INVENTION

It is one object of the invention to provide a chair configuration that both facilitates good, relaxed posture and provides adequate total back support when a user is properly seated.

Another object of the invention is to use such a chair configuration to produce greater comfort during prolonged sitting sessions, thus rendering it ideal for musicians or other individuals who find it necessary or desirable to remain seated for extended time periods.

These objects, as well as other objects and various features and advantages that will become apparent, are achieved by way of a chair according to the invention that is particularly adapted to provide comfort during prolonged seating periods and to facilitate proper sitting posture. Such a chair, according to the invention, includes a central chair portion defining a pair of seat back mounting sections, a pair of front leg mounting sections, a pair of rear leg mounting sections, and a seat surface. A seat back including a pair of seat back extensions is provided, with each of the seat back extensions mountable on one of the seat back mounting sections. A pair of front leg extensions is mountable on the front leg mounting sections of the central chair portion, while a pair of rear leg extensions is mountable on the rear leg mounting sections of the central chair portion. The seat back, the front leg extensions, and the rear leg extensions are all adjustable relative to the seat surface and lockable in any of a plurality of discrete positions with respect to the seat surface to produce the improved comfort during prolonged sitting sessions as noted above.

The central chair portion may be either collapsible or substantially rigid and non-collapsible. Manually releasable latches biased into locking engagement, may be disposed on the central chair portion to releasably secure the seat back, the front leg extensions, and the rear leg extensions in position relative to the seat surface. The front leg extensions, the rear leg extensions, or both the front leg extensions and the rear leg extensions can be substantially rigidly connected to each other by a support strut, if desired. It is also possible to include an arm rest assembly having an arm rest surface that is also lockable in a plurality of discreet positions relative to the seat surface. Rollers or casters could be disposed at ends of the front and rear leg extensions.

It is still another object of this invention to provide a locking mechanism for use on an adjustable folding chair that can be effectively and easily operated to allow a positional adjustment of the front or rear legs of the folding chair.

It is an advantage of this invention that the positional adjustment of the front and rear leg assemblies telescopically mounted on the central chair frame member can be accomplished with only one hand.

It is a feature of this invention that the locking mechanisms are mounted internally of the horizontal strut interconnecting leg extensions on both of the front and rear leg assemblies.

It is another advantage of this invention that the height of the seat member above the floor on which the chair is positioned can be selectively adjusted to locate the seat member at a comfortable height for the user.

It is another feature of this invention that the front of the seat member on the folding chair can be oriented at a different height than the rear of the seat member.

It is still another advantage of this invention that the seat member can be positioned to locate the hips of the user above the knees of the user.

It is yet another advantage of this invention that the folding chair incorporating the principles of the instant invention can be utilized for an orchestra or other situations where a user will be seated for an extended period of time.

It is still another feature of this invention that the actuator of the locking mechanism extends downwardly from the center of the horizontal strut for convenient access to both unlock the leg assembly and positionally move the leg assembly on the central chair frame.

It is yet another feature that each locking mechanism establishes a pin actuated, spring-loaded latch rod lock release mechanism that includes a pair of opposing locking pins mounted internally of the horizontal strut in the front and rear leg assemblies and spring-biased for engagement into the leg assembly to lock movement of the leg assembly relative to the central chair frame.

It is yet another advantage of this invention that the actuator operates both opposing locking pins simultaneously.

It is a further feature of this invention that the folding chair maintains a constant angular relationship between the seat member and the seat back irrespective of the height adjustment of the seat member.

It is a further advantage of this invention that the folding chair does not require additional adjustment for correcting the angular relationship between seat member and the seat back whenever a height adjustment of the seat member is made.

It is a further object of this invention to provide a folding chair for use by instrumentalists in an orchestra that can be adjusted to meet the desires configuration of the instrumentalist.

BRIEF DESCRIPTION OF THE DRAWINGS

The foregoing and other objects, features, and advantages of the invention will appear more fully hereinafter from a consideration of the detailed description that follows, in conjunction with the accompanying sheets of drawings. It is to be expressly understood, however, that the drawings are for illustrative purposes and are not to be construed as defining the limits of the invention.

FIG. 26 is a cross-sectional view through the front legs of the adjustable folding chair to depict an elevational detail view of the locking mechanism for the leg extensions as depicted in FIGS. 17-25, the locking mechanism being shown in a locked orientation;

FIG. 27 is a cross-sectional view similar to that of FIG. 26 to depict an elevational detail view of the locking mechanism, but depicting the locking mechanism in a release orientation;

FIG. 28 is a cross-sectional view of the adjustable folding chair to depict an elevational detail view of another alternative locking mechanism, the left locking pin being in a locked position while the right locking pin is in a release orientation, the movement of the left locking pin to the release orientation being shown in phantom;

FIG. 29 is a partial bottom plan view of the leg assembly to shown the actuator pins as depicted in FIG. 28.

DETAILED DESCRIPTION OF THE PREFERRED EMBODIMENT

Figure 1:
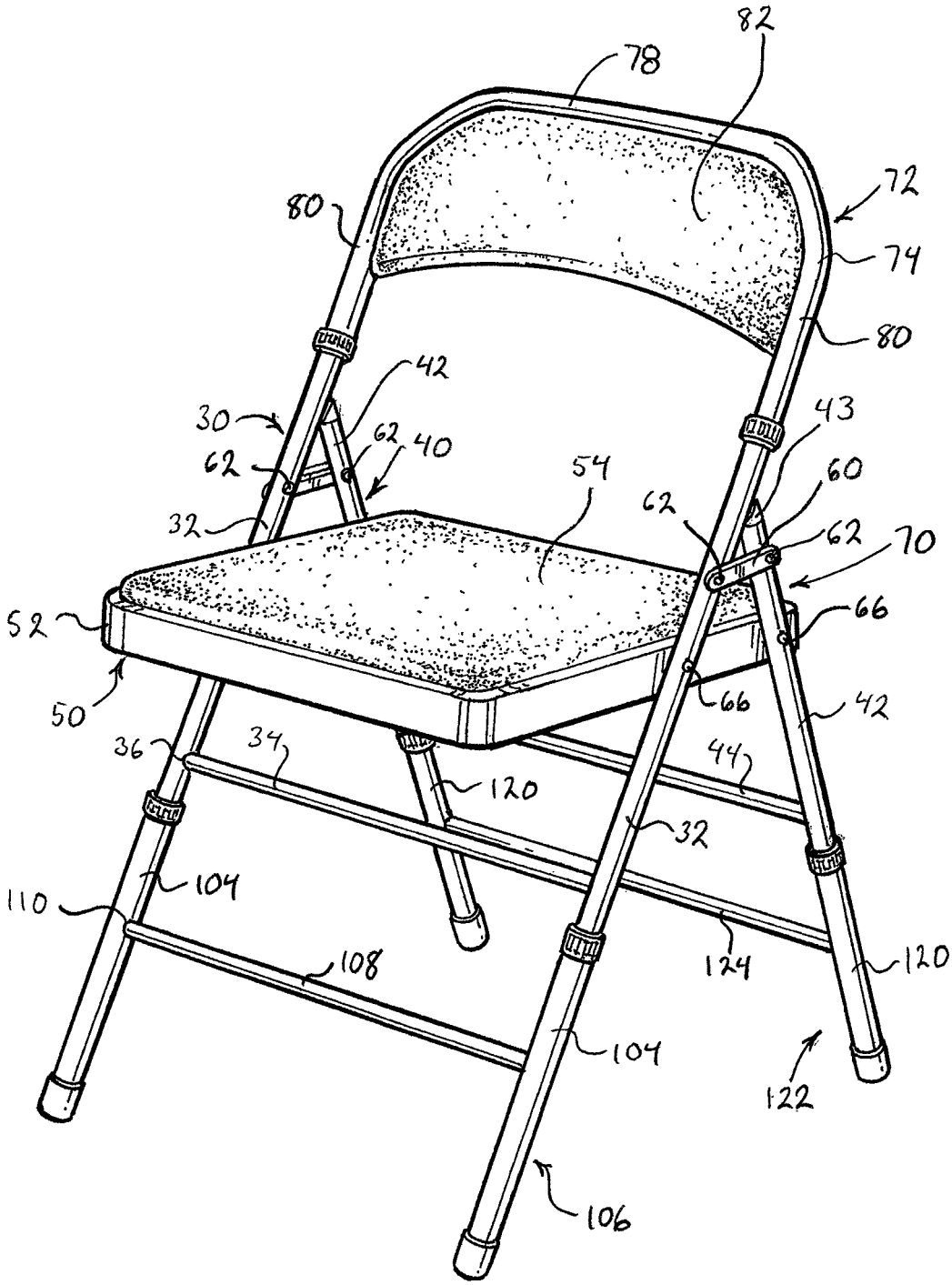
FIG. 1 is a perspective view from above of a first embodiment of an adjustable folding chair incorporating the principles of the instant invention.

The manner in which a first support frame 30, a second support frame 40, and a seat 50 cooperate to define a collapsible central portion of a first ALCAT chair embodiment is apparent from FIG. 1. The first support frame 30 is configured as a substantially rigid, approximately "H" shaped structure having substantially parallel side legs 32 interconnected by a laterally extending strut 34. The side legs 32 and the strut 34 could be made of any material appropriate for construction of collapsible chairs, such as wood, aluminum, steel, or plastic having sufficient strength and stiffness. In one configuration, the legs 32 and the strut 34 are constructed of ⅞" steel tubing, with the strut 34 spot welded at its ends to the legs 32 at appropriate locations 36.

The second support frame 40 is also configured as a substantially rigid, approximately "H" shaped structure. The second support frame has substantially parallel side legs 42 interconnected by a laterally extending strut 44. Again, the side legs 42 and the strut 44 could be made of any material appropriate for construction of collapsible chairs. In one configuration, the legs 42 are constructed of ⅞" steel tubing and the strut 44 is constructed of ⅝" steel tubing, with the strut 44 spot welded at its ends to the legs 42 at appropriate locations 46 (indicated in FIG. 8).

Figure 5:
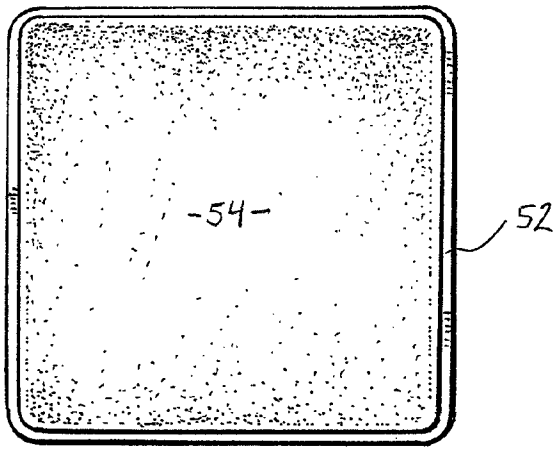
FIG. 5 is a top view of the seat or seat surface of the chair as well as of the supporting frame for the seat.
Figure 6:
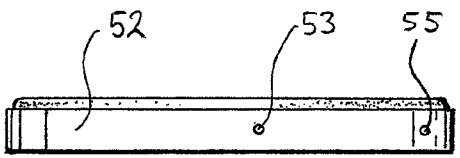
FIG. 6 is a side view of the seat shown in FIG. 5.

The seat 50 is defined by a substantially rigid seat frame 52. As illustrated in FIGS. 1, 5, and 6, the frame 52 has a square or rectangular perimeter, but it is to be noted that the perimeter of the frame 52 could be circular or oval or could have any other appropriate configuration. The seat surface 54 could either be constructed integrally together with the frame 52 as a single piece of material or, as shown in FIG. 1, defined by a separate, possibly removable, upholstered cushion or fabric surface, configured as desired aesthetically. It is imperative, however, that the seat be relatively flat and firm.

Figure 7:
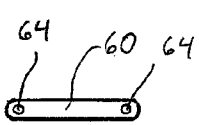
FIG. 7 is an enlarged view of one of a pair of hinge links partially interconnecting the support frames and seat of the first chair embodiment together.

A pair of hinge links 60 cooperates with the seat frame 52 to interconnect the first support frame 30, the second support frame 40, and the seat frame 52 together to produce the collapsible central ALCAT chair portion. Holes 64, best shown in FIG. 7, are drilled or otherwise defined at forward and rearward ends of the hinge links 60. The side legs 32 of the first support frame 30 are provided with holes 38 adapted to align with respective holes 64 at forward ends of the hinge links 60, while the legs 42 of the second support frame have holes 48 adapted to align with respective holes 64 at rearward hinge link ends. Bolts, rivets, or other such elements 62 extend through each aligned pair of holes 38, 64 and 48, 64 to pivotally secure each of the side legs 32 and 42 to respective ends of the hinge links 60.

Each of the first support frame side legs 32 is also provided with a hole 39 provided at a location below the location of the hole 38, while each of the second support frame legs 42 is also provided with a hole 49 provided at a location below the location of the hole 48. A bolt, rivet, or other such element 66 extends through each of the holes 39 in the first support frame 30 and an aligned hole 53 in the seat frame 52 to pivotally secure each of the side legs 32 to the seat frame 52. Another bolt, rivet, or other such element 66 also extends through each of the holes 49 in the second support frame 40 and an aligned hole 55 in the seat frame 52 to pivotally secure each of the side legs 42 to the seat frame.

Connecting a first support frame leg 32, a second support frame leg 42, one of the hinge links 60, and a side of the seat frame 52 together in this way produces a roughly trapezoidal lateral link 70 as shown in FIG. 1. Upper ends of the second support frame side legs 42 may be provided with resilient rubber or plastic caps or bumpers 43. Abutment between outside surfaces of the side legs 32 and either the upper ends of the second support frame side legs 42 or the bumpers 43, if they are provided, serves, together with the lateral links 70, to stabilize the central ALCAT chair portion when the overall chair is in its expanded, in use, open position.

Figure 2:
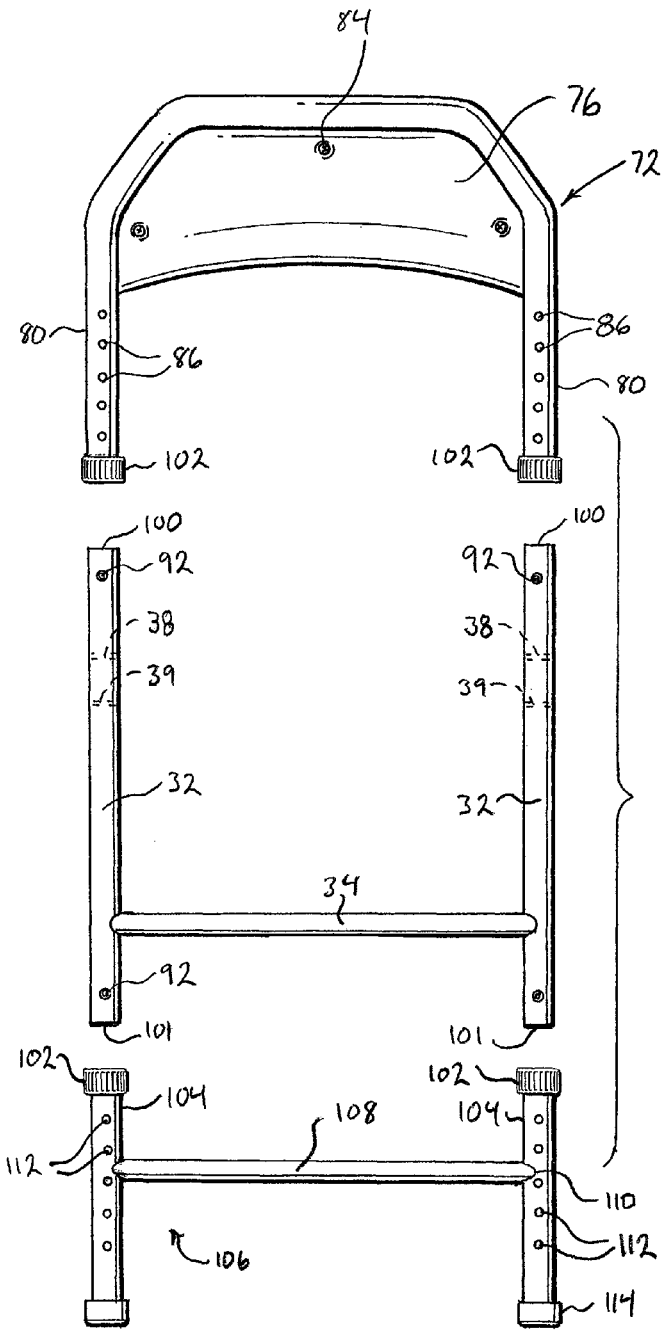
FIG. 2 is an exploded posterior view showing a first support frame, an adjustable seat back, and adjustable leg extensions of the chair shown in FIG. 1.

A seat back 72 is mountable on the side legs 32 of the first support frame so as to be displaceable along the side leg longitudinal axes. In the configuration shown in FIGS. 1 and 2, the seat back 72 includes an approximately "U" shaped seat back frame 74 having a web 76 (FIG. 2) interconnecting the base 78 and legs 80 of the frame 74. For reasons that will become clear, the legs 80 can properly be referred to as seat back extensions. In one configuration, the base and legs could be formed of a unitary bent piece of one inch steel tubing and the web could be a steel sheet of appropriate thickness welded to the tubing. For comfort and pleasing aesthetics, fabric or a separate, possibly removable cushion 82 could be constructed integrally with or attached removably to the seat back 72. As illustrated in FIGS. 1 and 2, the cushion 82 is attached removably to the web 76 by fasteners 84, such as screws.

Figure 3:
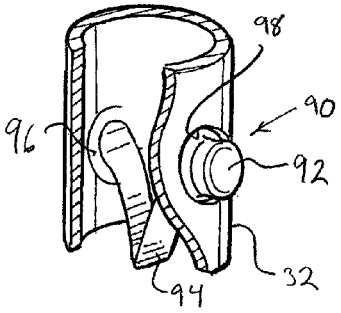
FIG. 3 is an enlarged, part sectional view of a locking device formed by a manually releasable latch.

To provide for locking the seat back 72 in a plurality of discrete positions along the side leg longitudinal axes, each leg 80 of the seat back frame 74 is provided with a longitudinally extending series of openings 86. In the configuration shown, the openings 86 are provided in walls of tubing forming the seat back frame 74. Each of the openings 86 is configured to cooperate with a spring button mechanism 90, which is provided near an upper end 100 of each first support frame leg 32 and defines a manually releasable latch. The spring button mechanism, best shown in FIG. 3, serves to lock the seat back frame legs 80 and the first support frame side legs 32 in position relative to each other. Each spring button mechanism includes an approximately cylindrical button or cap 92 welded or otherwise secured to or provided with a biasing element 94, such as a leaf or coil spring. In the configuration illustrated in FIG. 3, the biasing element 94 has a base 96 secured in any convenient manner to a wall of one of the first support frame legs 32. The button or cap 92 of each mechanism protrudes through an opening 98 in the support frame side leg 32 approximately diametrically opposed to the base 96.

To lock the seat back 72 in a discrete position relative to the first support frame side legs 32, the upper ends 100 of the first support frame side legs 32 are inserted into the larger diameter lower ends of the seat back frame legs 80. The tops of the legs 32 thus form a pair of seat back mounting sections. The buttons or caps 92 are biased under action of the biasing elements 94 through aligned openings 98 and 86 to produce releasable locking engagement between the seat back 72 and the first support frame 30. By pressing the buttons or caps 92 inwardly into openings 86 against forces applied by the elements 94, a user can disable locking engagement between the buttons or' caps and the holes and adjust the overall position of the seat back 72 relative to the support frame 30.

Once a desired relative position between the seat back 72 and the support frame 30 is reached, the buttons or caps 92 can be permitted by a user to remain engaged within the appropriate set of openings 86 to lock the seat back 72 in the desired position. Conventional locking nuts 102 may also be included at the lower ends of the seat back frame legs 80 to provide added or redundant frictional locking between the first support frame legs 32 and the seat back frame legs 80. The seat back 72 can be removed from engagement with the first support frame legs 32 by releasing the locking nuts 102, again pressing the buttons or caps 92 inwardly into openings 86 against forces applied by the elements 94 to disable locking engagement between the buttons or caps and the holes, and withdrawing the first support frame legs 32 from the lower ends of the seat back frame legs 80.

Each of the first support frame legs 32 also has a lower end 101 that is receivable in a respective leg or leg extension 104, which, as illustrated, is formed by a tube, constituting part of a first support leg extension frame 106. The lower ends of the legs 32 thus form a pair of front leg mounting sections for legs or leg extensions 104. The leg extension frame 106 includes a pair of the leg extensions 104 interconnected by a laterally extending support strut 108 and, as shown, is configured so as to have a substantially rigid, approximately "H" shaped structure. The leg extension frame 106 could be, made of any material appropriate for construction of collapsible chairs, such as aluminum, steel, plastic having sufficient strength and stiffness, or even wood. As illustrated, the frame 106 is constructed of steel, with the support strut 108 spot welded at its ends to the leg extensions 104 at appropriate locations 110. Each of the leg extensions 104 is provided with a longitudinally extending series of openings 112 configured similarly to the openings 86 in the seat back frame.

Figure 4:
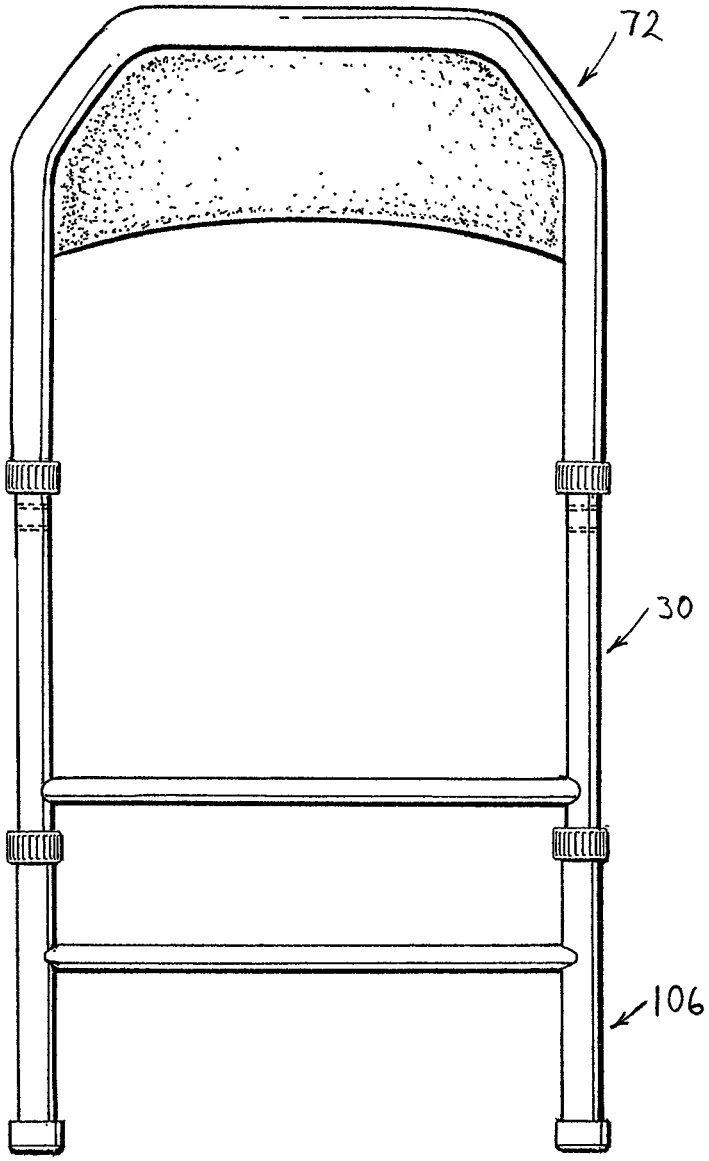
FIG. 4 is a front view of the elements illustrated in FIG. 2 in an assembled condition.

Each series of openings 112 respectively cooperates with another spring button mechanism 90, configured essentially the same as the spring button mechanism described above, located adjacent a lower end 101 of a support frame leg 32. The spring button mechanisms 90 and the openings 112 together provide for locking the first support leg extension frame 106 in and releasing the first support leg extension frame from discrete positions along the side leg longitudinal axes. Conventional locking nuts 102 may again be included around the upper ends of the leg extensions 104 to provide added or redundant frictional locking between the first support frame legs 32 and the leg extensions 104 of the first support leg extension frame 106. Rubber or plastic caps 114 can be provided at lower ends of the leg extensions 104 to avoid undue wear on floors or other support surfaces. FIG. 4 shows the first support frame 30, the seat back 72, and the first support leg extension frame 106 in an assembled condition.

Each of the second support frame side legs 42 has a lower end that is receivable in a respective leg or leg extension 120, which, as illustrated, is formed by a tube, constituting part of a second support leg extension frame 122. The lower ends of the legs 42 thus form a pair of rear leg mounting sections. The leg extension frame 122 includes a pair of the leg extensions 120 interconnected by a laterally extending support strut 124 and is configured essentially identically to the first support leg extension frame 10K Each of the leg extensions 120 is provided with a longitudinally extending series of openings 126, again configured similarly to the openings 86 in the seat back frame 74. Each series of openings 126 respectively cooperates with yet another spring button mechanism 90, configured essentially the same as the spring button mechanism described above, located adjacent the lower end of each of the second support frame side legs 42.

Figure 8:
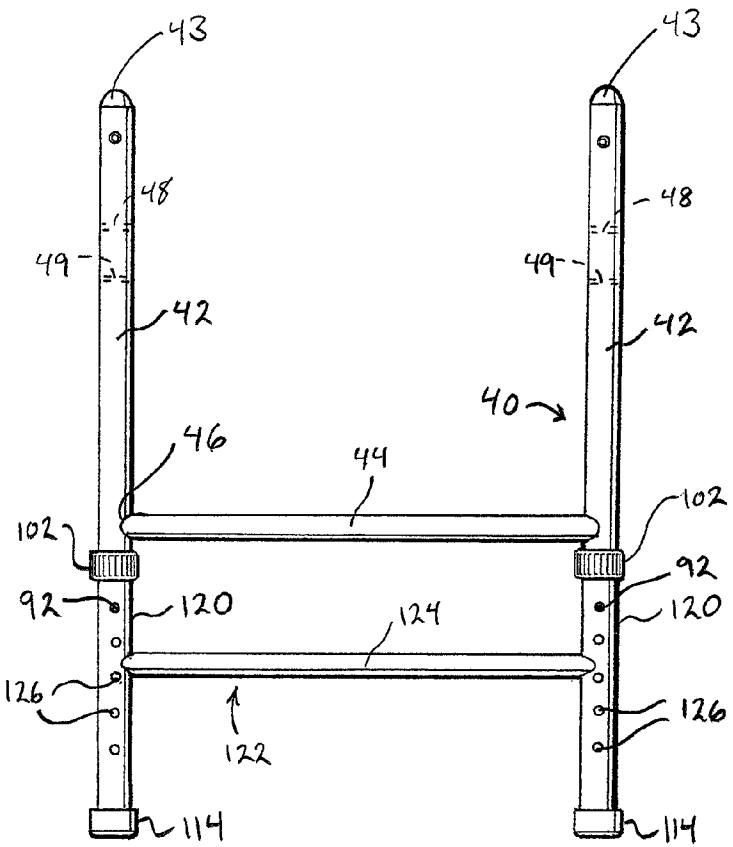
FIG. 8 is a view illustrating a second support frame and adjustable leg extensions of the chair shown in FIG. 1.

FIG. 8 illustrates the buttons or caps 92 of such spring button mechanisms received in openings 126 to lock the second support leg extension frame 122 in a discrete position with respect to the second support frame 40. As with the first support leg extension frame 106, the spring button mechanisms and the openings 126 together provide for locking the second support 'leg extension frame 122 in and releasing that second support leg extension frame from discrete positions along the side leg longitudinal axes. Conventional locking nuts 102 may once again be included, this time at the upper ends of the leg extensions 120 to provide the added or redundant frictional locking noted previously, and rubber or plastic caps 114 can be provided at lower ends of the leg extensions 120.

Exemplary dimensions and compositions of certain parts of the adjustable folding chair embodiments are mentioned above. Some of these dimensions and compositions will now be reiterated in the following overall discussion, which is set forth simply in order to provide an illustration of the size of one embodiment of the invention and is not to be considered limiting in any way. As noted above, the side legs 32 and the strut 34 can be formed of ⅞" outer diameter spot welded steel tubing. Centers of holes 38 and 39 in each leg 32 can be separated by 2 inches, and centers of holes 38 can be separated from openings 98 by 9 inches. The center of each hole 39 can be separated from the longitudinal centerline of the strut 34 by 6", and from the respective lower end 101 by 17". The strut 34 may have a length of 16.25", Many dimensions of the frames 106 and 122 are essentially the same. The support struts 108, 124 may be formed of ⅞" outer diameter tubing, can have a length of 16.125", and may have centerlines displaced 3" from the location of the locking nut 102 disposed at the upper end of leg extensions 104, 120. The leg extensions 104, 120 may be formed of 1" tubing. Openings 86, 112, and 126 in each respective series of openings may be spaced 1" apart, and each series shown in the drawing Figs. includes five openings.

The U-shaped seat back frame 74 may be .constructed of 1" outer diameter tubing, and the lateral fasteners 84 (FIG. 2) may be disposed approximately 10" vertically from the underside of the locking nuts 102 disposed on ends of the legs 80.

The seat frame 52 may be 16"×16", 0.125" thick, and 1.50" to 1.75" deep. The hole 53 may have its center displaced 9" from the front edge of the frame 52, while the hole 55 may have its center displaced 1.50" to 1.75" from the rear edge of the frame 52.

Finally, the hinge link 60 may be 4.5" in length, the strut 49 may be 16.25" in length, each hole 48 may be separated by 1.25" from the tip of a cap or bumper 43 and by 5.5" form a centerline of the strut 44. Each leg 42 may have an overall length of 19.75".

Figure 9:
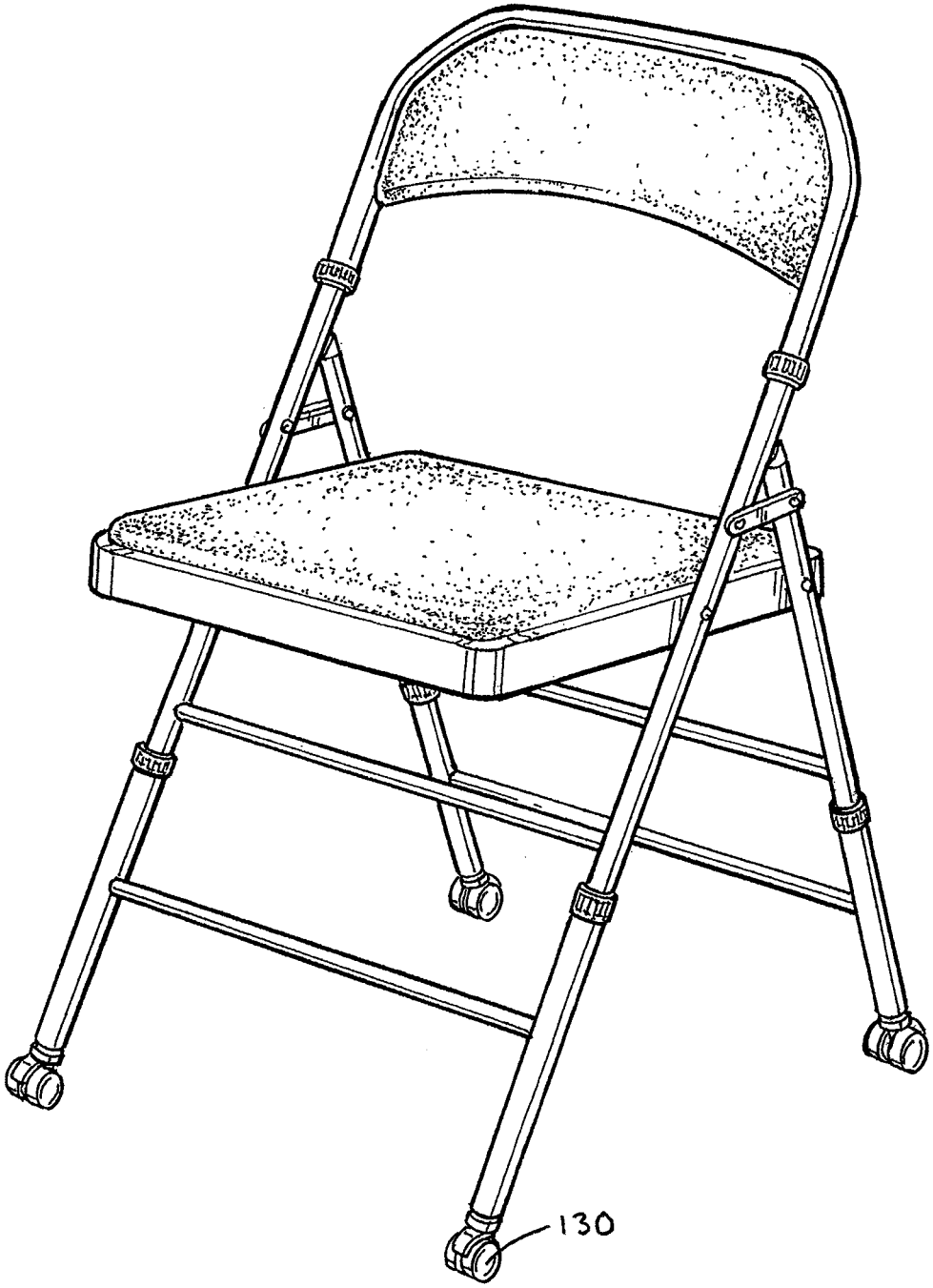
FIG. 9 shows a second embodiment of a chair according to the invention that includes rollers or casters mounted on lower ends of the leg extensions.

The second adjustable folding chair embodiment illustrated in FIG. 9 is essentially the same as the first embodiment, except that rollers or casters 130 are provided at lower ends of the leg extensions 104 in place of the caps 114 included in the first embodiment. The rollers or casters 130 provide the chair with improved mobility. The rollers may be approximately 2" in diameter, although this dimension is not critical and could be significantly larger or smaller.

Figure 10:
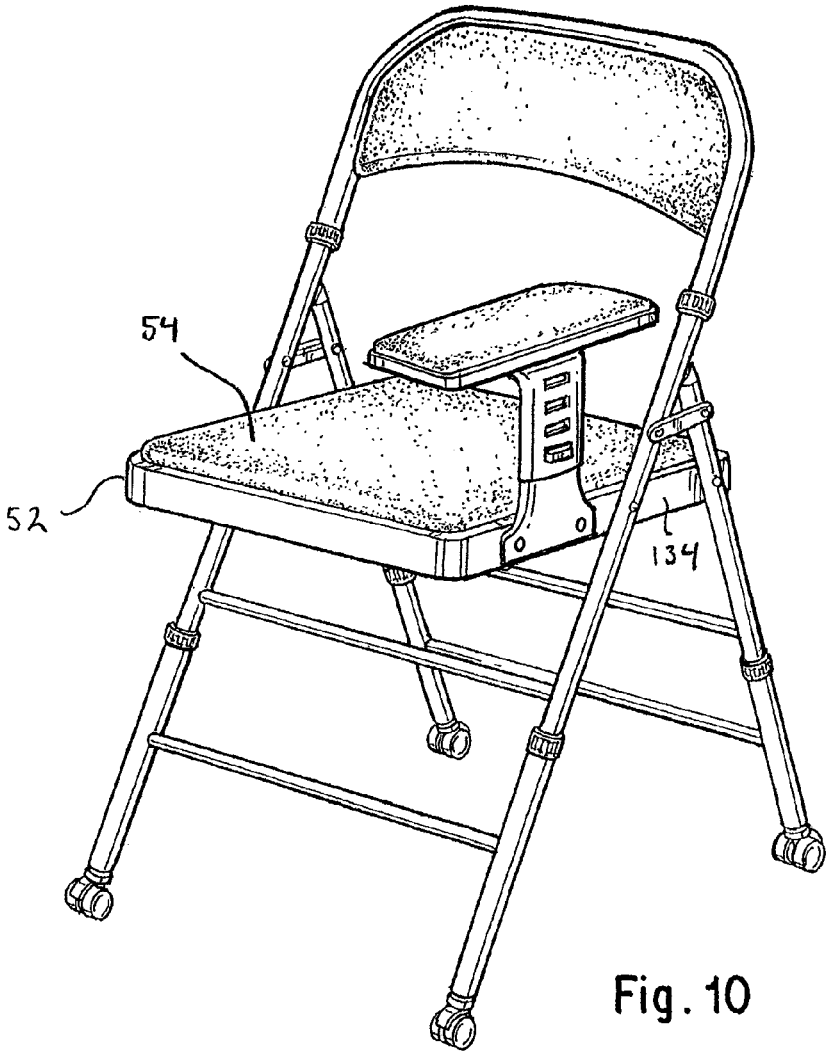
FIGS. 10 and 11 show an adjustable arm rest assembly.
Figure 11:
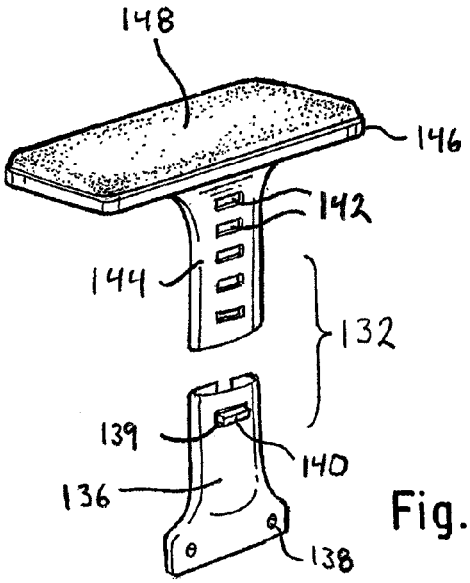

FIGS. 10 and 11 show a version of the second chair embodiment having an adjustable arm rest assembly 132 mounted on one side 134 of the seat frame 52. The arm rest assembly 132, of course, could be utilized in conjunction with the first adjustable folding chair embodiment described above. An additional adjustable arm rest assembly could also be mounted on the other side of the seat frame if support for both arms of the adjustable folding chair user is desired.

The arm rest assembly includes a base 136 connectable to the seat frame 52, for example by fasteners, such as bolts, screws, or rivets, passing through holes 138. The base 136 may be a pressed metal sheet or solid metal, possibly plastic or another material, and includes an opening 139 in one of its walls through which a spring biased button 140 extends. The button 140 is dimensioned to protrude through any of a series of openings 142 provided in a stem 144 to which an arm rest 146 is mounted or with which the arm rest is integrally formed. A pad or cushion 148 may be provided on the arm rest 146 for comfort. The stem 144, in the configuration illustrated, defines a sleeve which fits over the base 136 for vertical movement. The arm rest 146 is lockable in any of a number of discrete vertical positions relative to the seat surface 54 by spring biased movement of the button 140 into an appropriately aligned opening 142. Another ergonomically adjustable feature is thus provided by the arm rest assembly or assemblies.

Exemplary dimensions of the arm rest assembly components are now provided solely to provide an illustration of the size of that assembly. These exemplary dimensions are not to be considered limiting in any way. The base 136 may be 8.5" in height, 3" wide at its base, and 2.5" wide at its upper end. The stem 144 may be 2.75" in width, and the series of openings 142 may provide for 8" of adjustability. The pad or cushion may have a 1" thickness and an 8" length.

Figure 13:
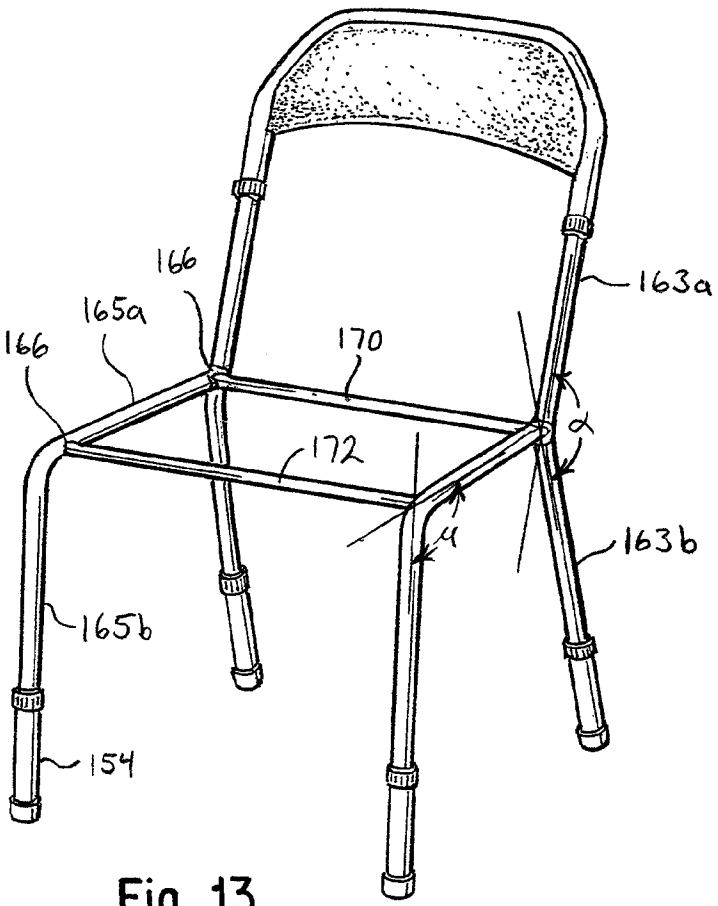
FIGS. 12 and 13 illustrate yet another embodiment of the chair in which the central portion of the chair is substantially rigid and non-collapsible.
Figure 12:
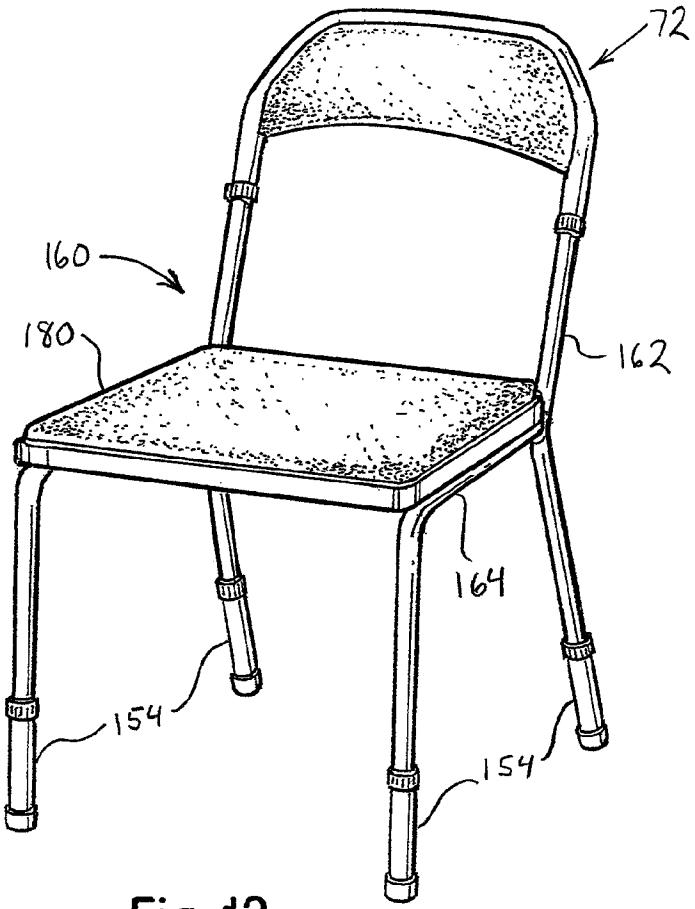

FIGS. 12 and 13 show an adjustable non-folding chair configuration with a substantially rigid, non-collapsible central portion 160. In this configuration, the seat back 72 is identical to the seat back 72 described in connection with the first adjustable folding chair embodiment. Leg extensions 154 of this configuration, however, differ from the leg extensions 104 and 120 of the first adjustable folding chair embodiment in that the extensions 154 of the present configuration are independent of one another and are not interconnected by support struts. In all other respects, the extensions 154 are configured identically to the leg extensions 106 and 120 described previously.

The non-collapsible central portion 160 of the configuration illustrated in FIGS. 12 and 13 includes a rear support frame 162 and a front support frame 164. Each of the front and rear support frames 162, 164 may be constructed of tubing similar to that of the first support frame 30 or the second support :frame 40 of the first adjustable folding chair embodiment. The rear support frame 162 is composed of a pair of parallel frame elements, each including sections 163*a* and 163*b*, and a rear cross strut 170. Each frame element is bent slightly in an approximately central portion thereof so that central axes of the sections 163*a* and 163*b* define an obtuse angle $\alpha$ relative to one another.

The front support frame 164 includes a pair of parallel frame elements, each including sections 165*a* and 165*b*. In this embodiment, therefore, the tops of sections 163*a* define a pair of seat back mounting sections, the bottoms of leg sections 163*b* define a pair of rear leg mounting sections, and the bottoms of leg sections 165*b* define a pair of front leg mounting sections. The seat section 165*a* of each frame element is joined by a weld 166 to one of the rear frame elements at an apex defined by the junction of the sections 163*a* and 163*b*. The welds 166 also serve to connect the rear cross strut 170 between the apices of the rear frame elements. The front support frame 164 also includes a front cross strut 172. Each of the front support frame elements is bent significantly in an approximately central portion thereof so that central axes of the sections 165*a* and 165*b* define a small obtuse angle $\mu$ (less than approximately 120°) relative to one another, thus eliminating any need to weld the sections 165*a* and 165*b* together. Each seat section 165*a* of the front support frame 164 is joined by another weld 166 to one end of a front cross strut 172, while each leg section 165*b* receives one of the extensions 154 as shown. A seat 180, defining a seat surface, is removably mounted on the seat sections 165*a* and/or the cross struts 170, 172 as illustrated.

Figure 14:
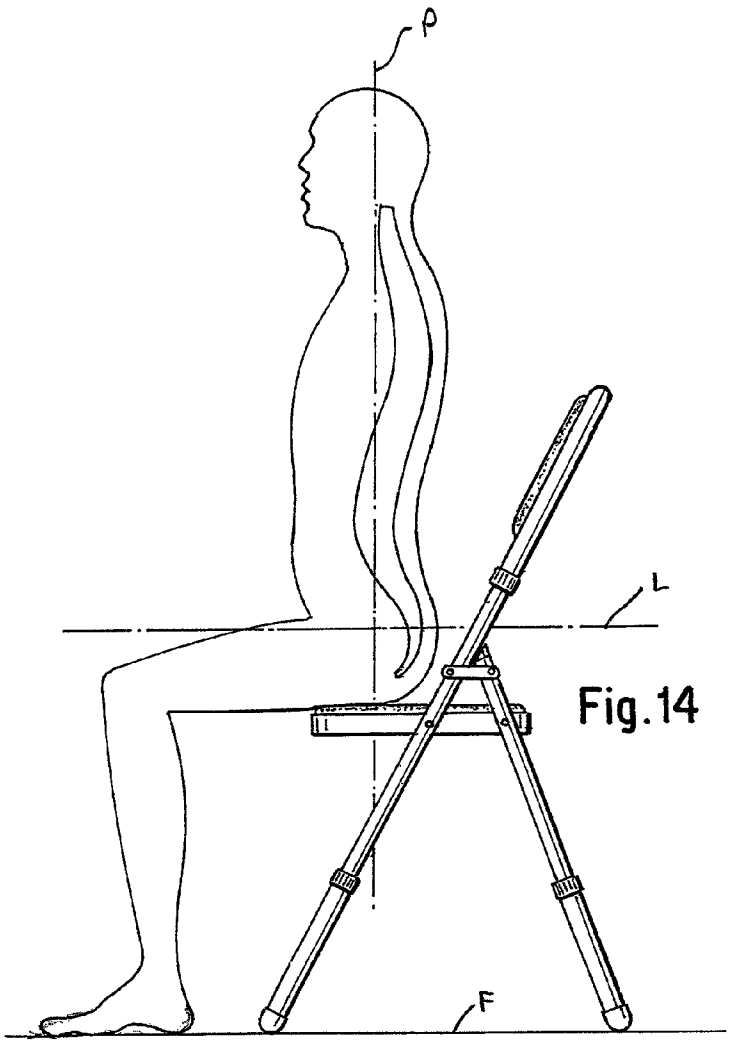
FIG. 14 shows the user of a chair according to the invention in one preferred sitting position.
Figure 16:
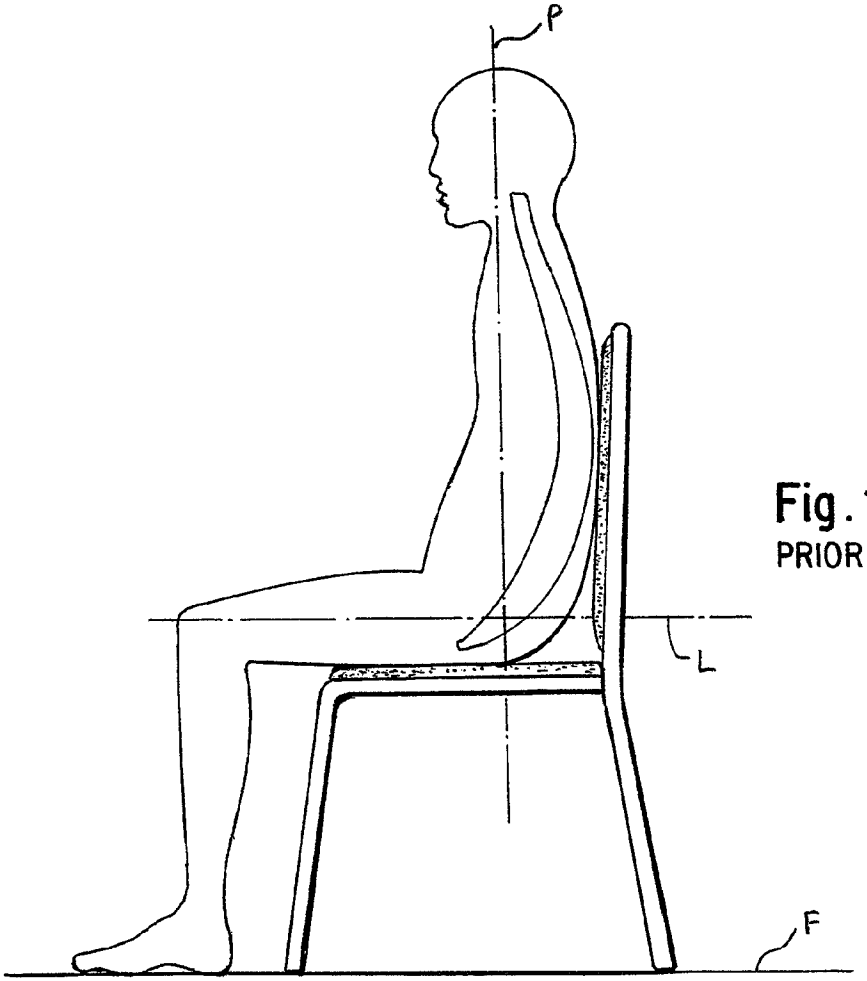
Fig. 16 PRIOR ART
FIG. 16 illustrates a user sitting on a conventionally constructed chair.
Figure 18:
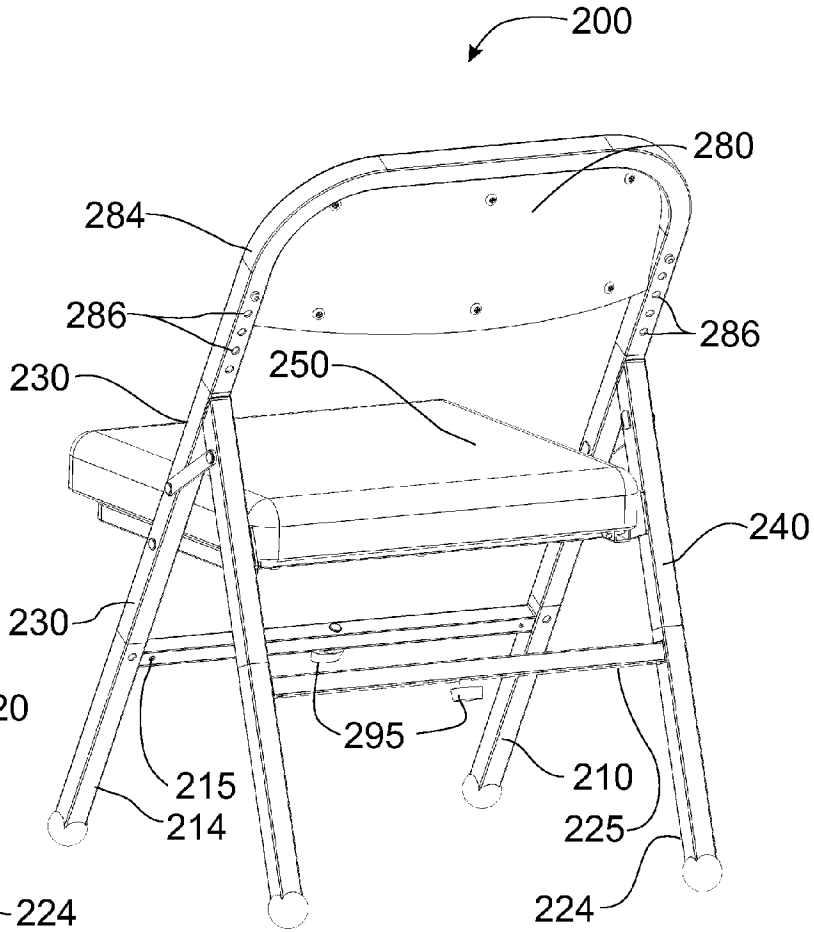
FIG. 18 is a rear perspective view of the adjustable folding chair shown in FIG. 17.
Figure 17:
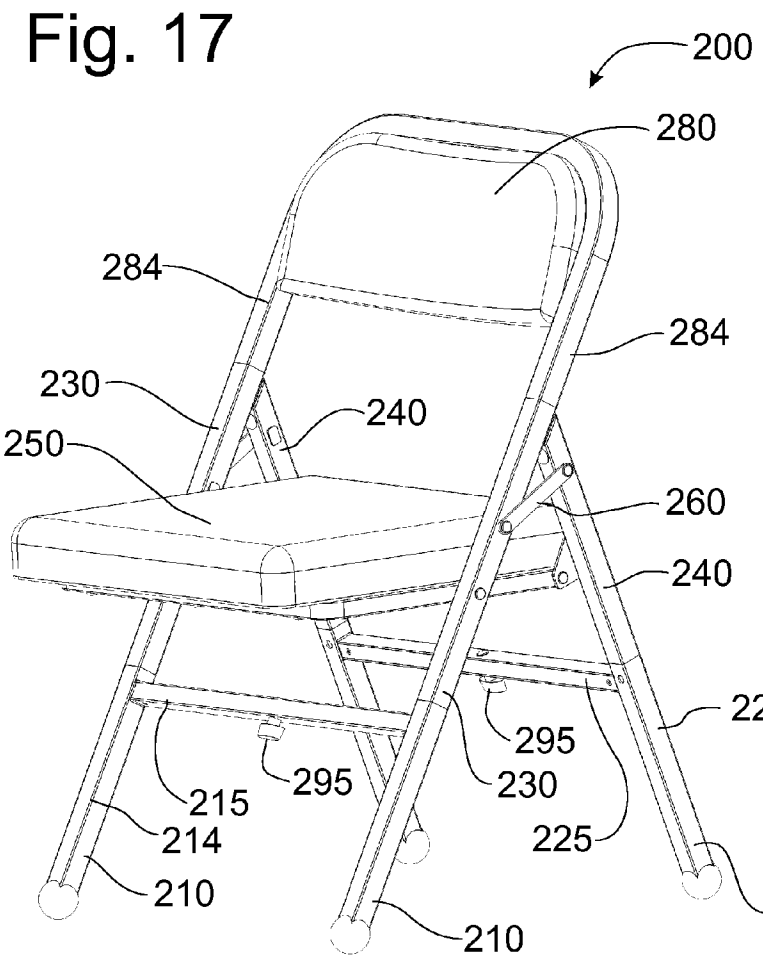
FIG. 17 is a front perspective view of yet a further alternative embodiment of the adjustable folding chair incorporating the principles of the instant invention.
Figure 20:
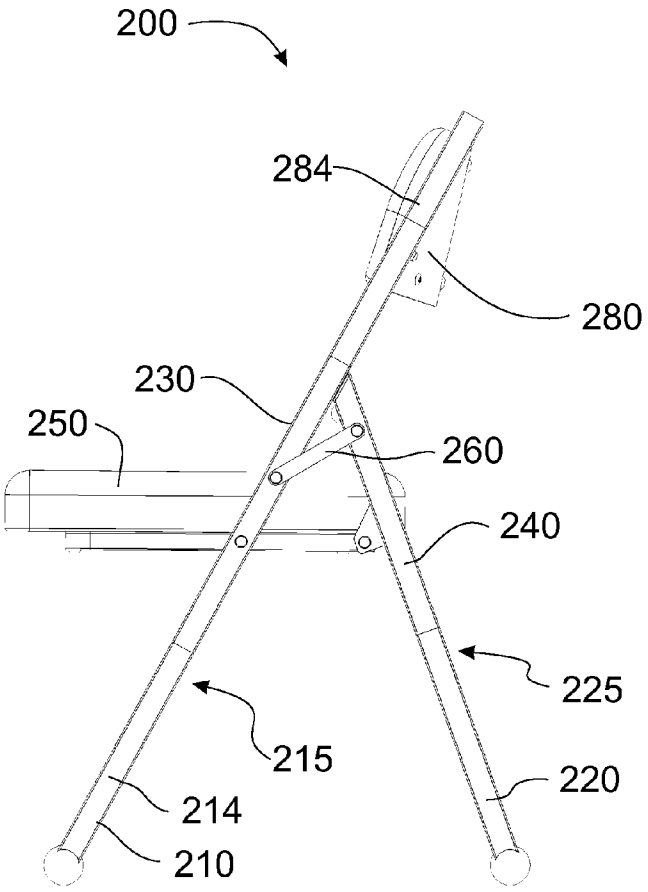
FIG. 20 is a side elevational view of the adjustable folding chair of FIG. 17.
Figure 19:
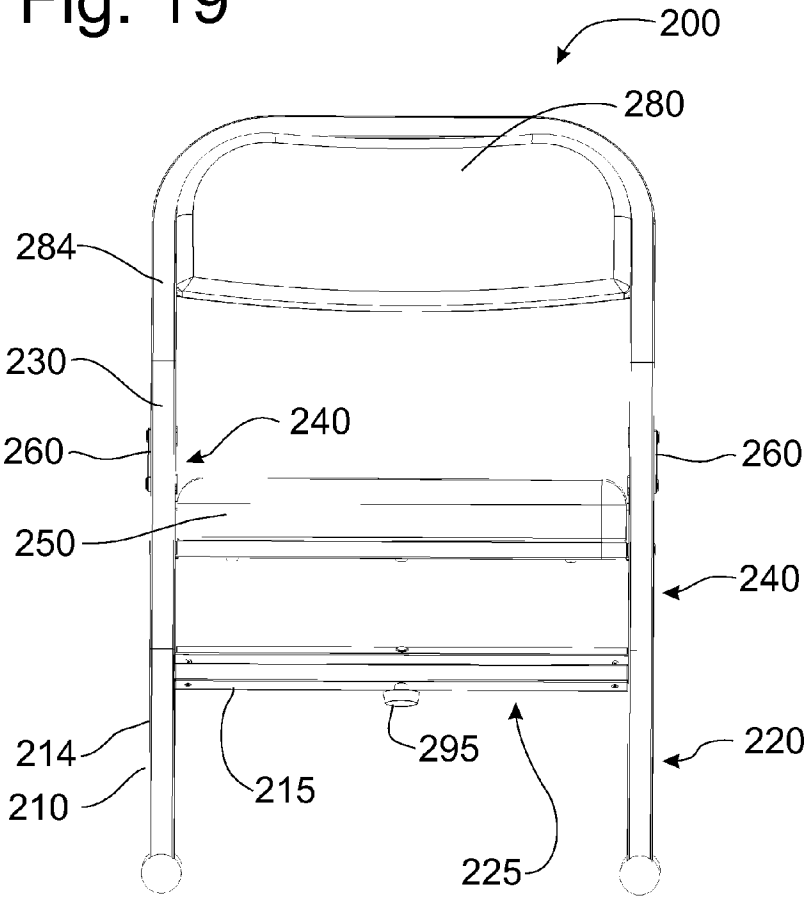
FIG. 19 is a front elevational view of the adjustable folding chair of FIG. 17.

FIG. 14 illustrates a "base" position of a user that allows freedom of movement and natural return to a "base" or "norm," and is considered the most relaxed sitting position. The base position shown in FIG. 14 minimizes the pull of gravity on the body and associated stresses produced due to misalignment. This is due to the essentially upright or 'perpendicular position of the user's torso relative to the seat surface, which minimizes the body area subjected to the force of gravity. The user's position shown in FIG. 14 is suitable for times in which the ischia (sit bones) of the user are located at or near the edge of the seat surface. When viewed laterally, with "good" sitting posture, a plumb line P perpendicular to the floor F is aligned with the user's ear, shoulder, hip joint, and ischium. In the preferred, most comfortable sitting position, a line L parallel to the floor at the level of the user's hip joint is slightly higher than the user's knee joint. Many professionals who spend a great deal of time sitting, such as musicians, prefer the position shown in FIG. 14, as this position allows the entire pelvic area to be aligned in a manner similar to the alignment provided by way of proper standing posture. As the knees of the user are lifted, muscles in the lumbar sacral area are put in tension.

Figure 15:
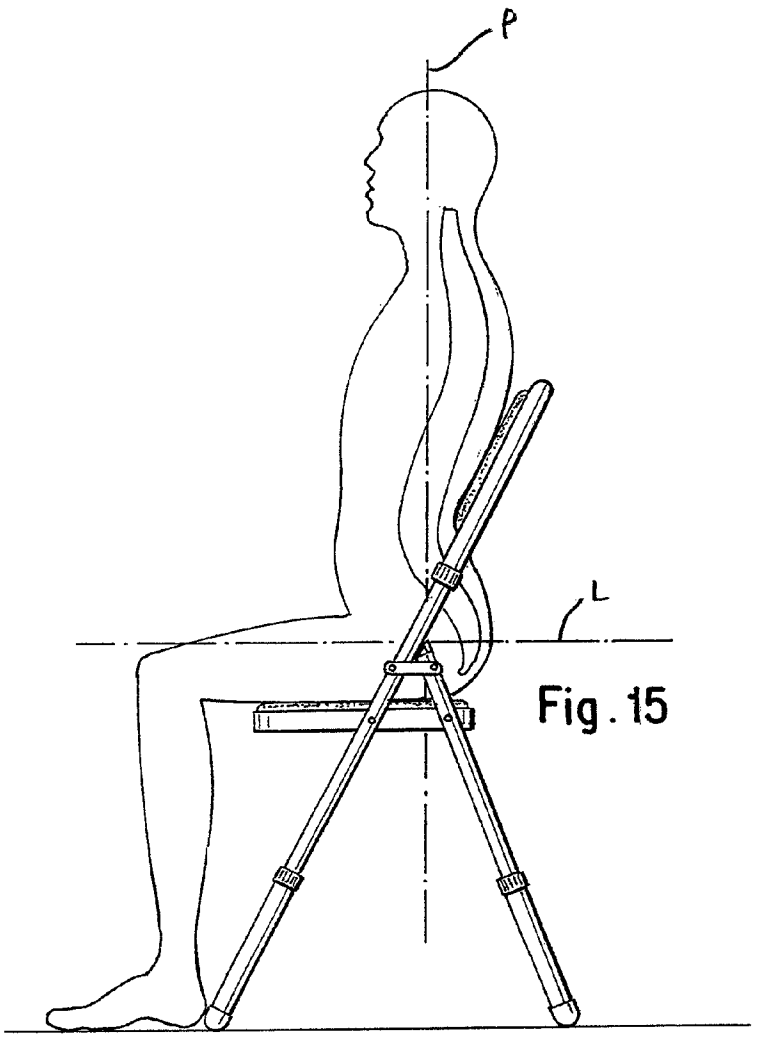
FIG. 15 shows the user of a chair according to the invention in another preferred sitting position.

The position illustrated in FIG. 15 is similar to that illustrated in FIG. 14, but with buttocks of the user positioned so as to protrude partially through an open space surrounded, for example, by the cushion 82, the seat surface 54, and the side legs 32 of the first adjustable folding chair configuration. The open space should he sufficiently wide and tall to permit the buttocks to readily protrude as illustrated. As FIG. 15 shows, the plumb line P can be maintained with provision of an open space having adequate area. The adjustable leg extension frames or leg extensions and the adjustable back rest of the adjustable folding chair incorporating the principles of the instant invention allow vertical adjustment of portions of the seat surface so that the knee of a user is at or below the level of the hip joint. Each individual user, of course, could modify the positions of the back rest cushion and either the adjustable leg extension frames (FIGS. 1, 2, 4, and 8-10) or any of the individual legs (FIGS. 12-13) for optimal comfort. The chair incorporating the instant invention thus facilitates good, relaxed posture and, at the same time, provides adequate total back support when a user is in a proper sitting position so as to produce greater comfort for prolonged sitting sessions, thus rendering it ideal for musicians or other individuals who find it necessary or desirable to remain seated for extended time periods.

Referring now to FIGS. 17-25, yet a further embodiment of an adjustable folding chair incorporating the principles of the instant invention can best be seen. The general components of the embodiment of the adjustable folding chair 200 are similar to those described above. The chair 200 has a front central frame 230 and a rear central frame 240, best seen in FIG. 24, pivotally connected to the seat member 250 and to a hinge link member 260. Each of the front and rear central frame members 230, 240 has a pair of lower reduced diameter portions 232, 242, respectively, at the lower ends thereof to fit telescopically into the front and rear leg extensions 210, 220 to provide the selectively adjustable height function for the seat member 250. Similarly, the upper portion of the front central frame 230 includes a pair of upper reduced diameter portions 236 that are sized to fit telescopically into the seat back 280 to provide a vertical adjustment for the seat back 280.

Both of the front and rear leg extensions 210, 220 are formed in the above-described "H" shape with generally vertical leg members 214, 224 interconnected, respectively, by a generally horizontal strut 215, 225. The vertical leg members 214, 224 are sized to receive the respective lower reduced diameter portions 232, 242 so as to be telescopic therefrom. The seat back 280 is formed in a U-shape with downwardly extending arms 284 that are sized to receive the upper reduced diameter portions 236 in a telescopic relationship. Preferably, the arms 284 are formed with a plurality of vertically spaced openings 286 in the back side thereof to engage a spring detent 285 carried in each of the upper reduced diameter portions 236. The spring detents 285 can be depressed manually into the interior of the upper reduced diameter portions 236 to permit the seat back 280 to be raised or lowered on the upper reduced diameter portions 236 to the height desired for the seat back 280 above the seat member 250, whereupon the spring detents 285 will pop back through the corresponding aligned openings 286 to secure the position of the seat back 280 on the front central frame member 230.

Figure 22:
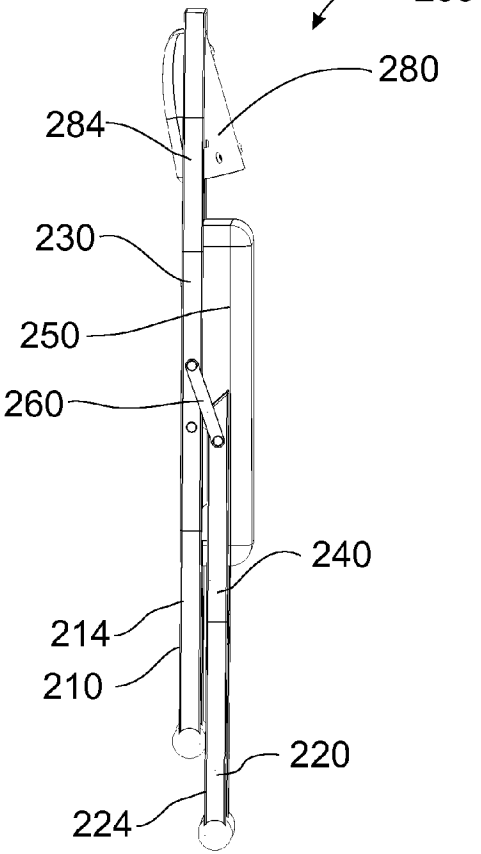
FIG. 22 is a side elevational view of the folded chair depicted in FIG. 21.
Figure 21:
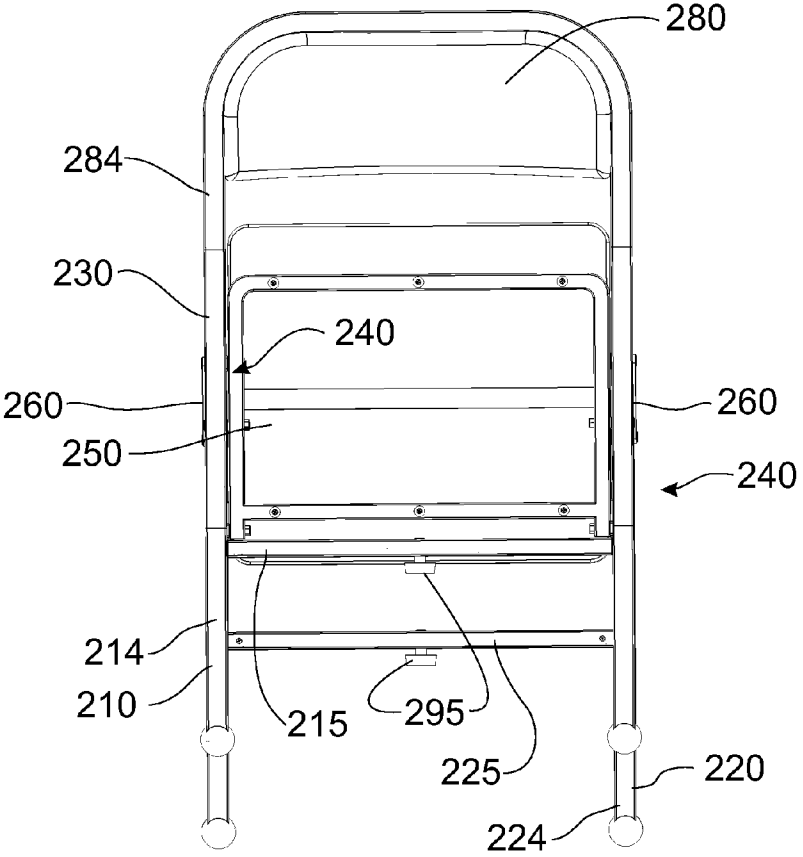
FIG. 21 is a front elevational view of the adjustable folding chair of FIG. 17, but shown in a folded configuration for storage.
Figure 23:
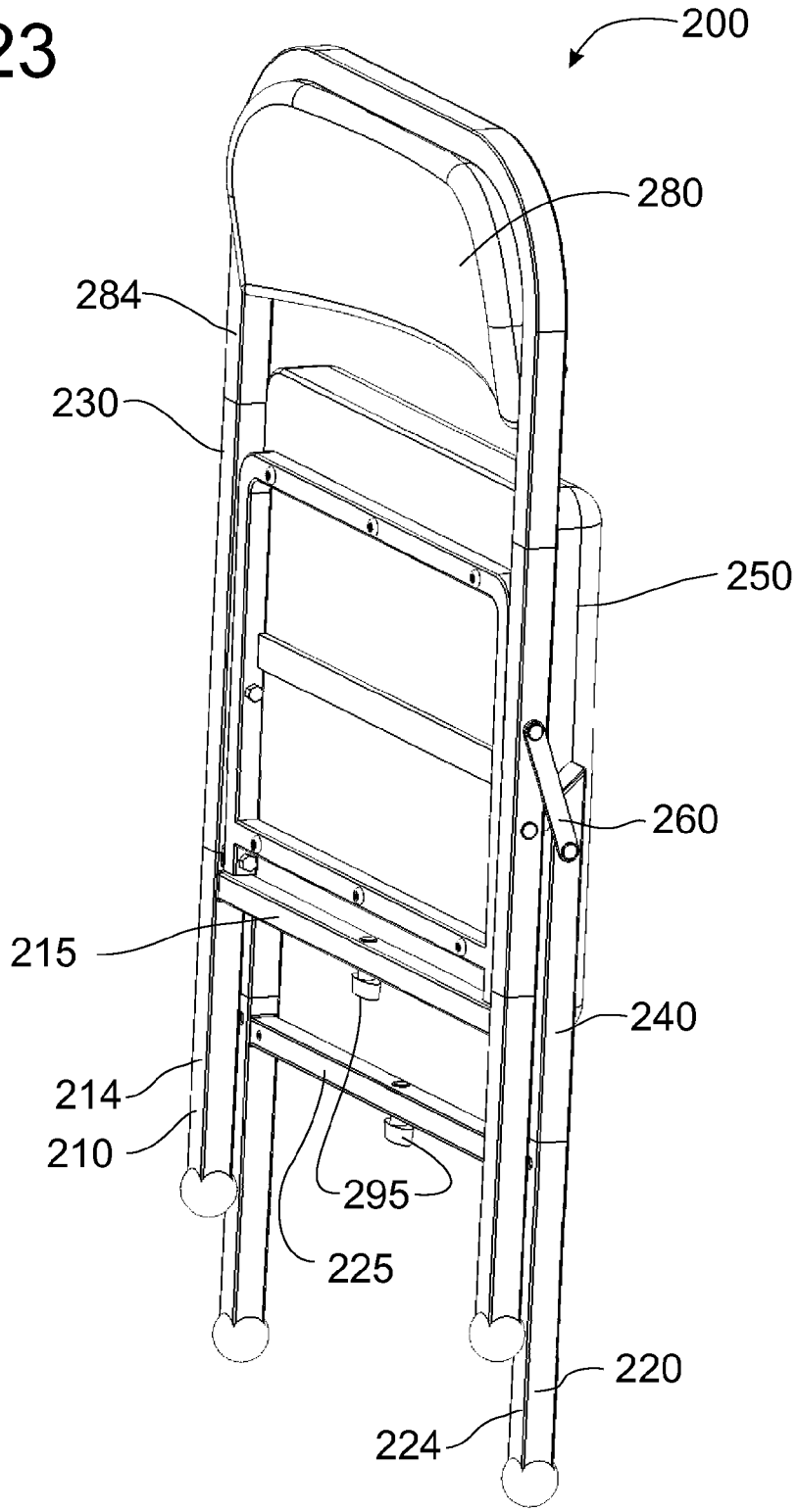
FIG. 23 is a front perspective view of the folded chair shown in FIG. 21.
Figure 24:
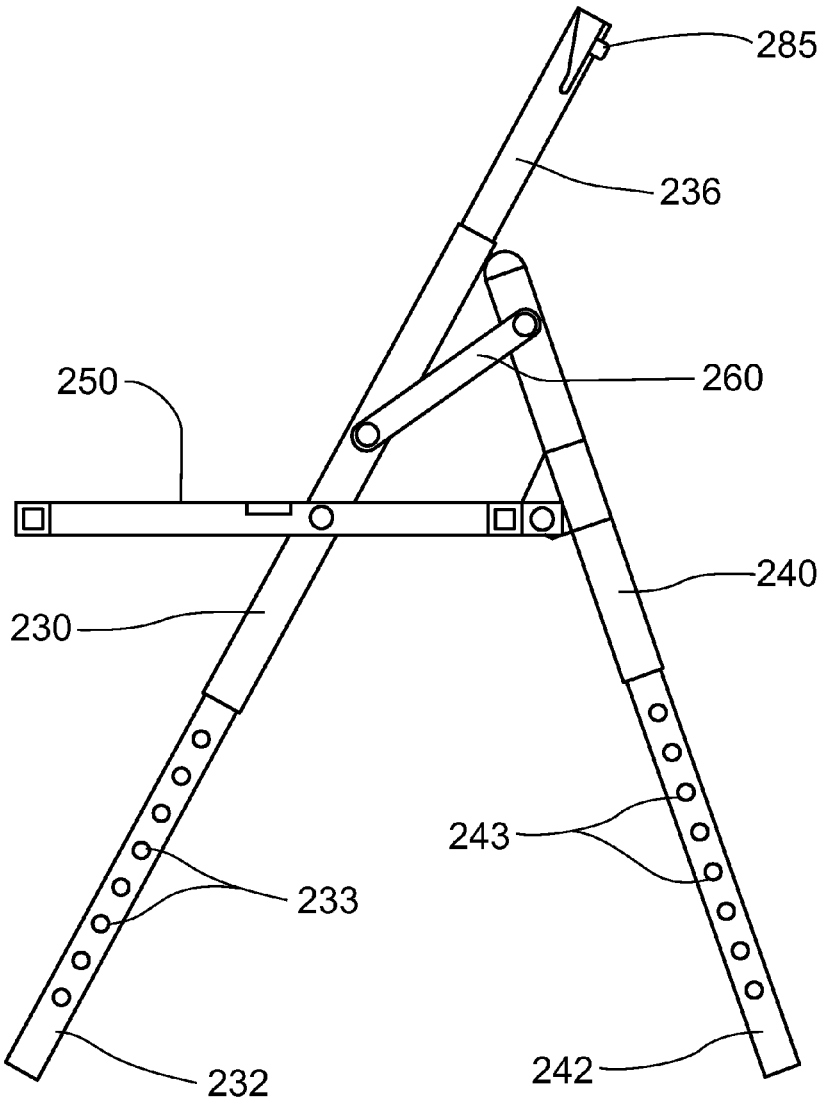
FIG. 24 is an enlarged side elevational view of the central support frame of the adjustable folding chair shown in FIG. 17.
Figure 25:
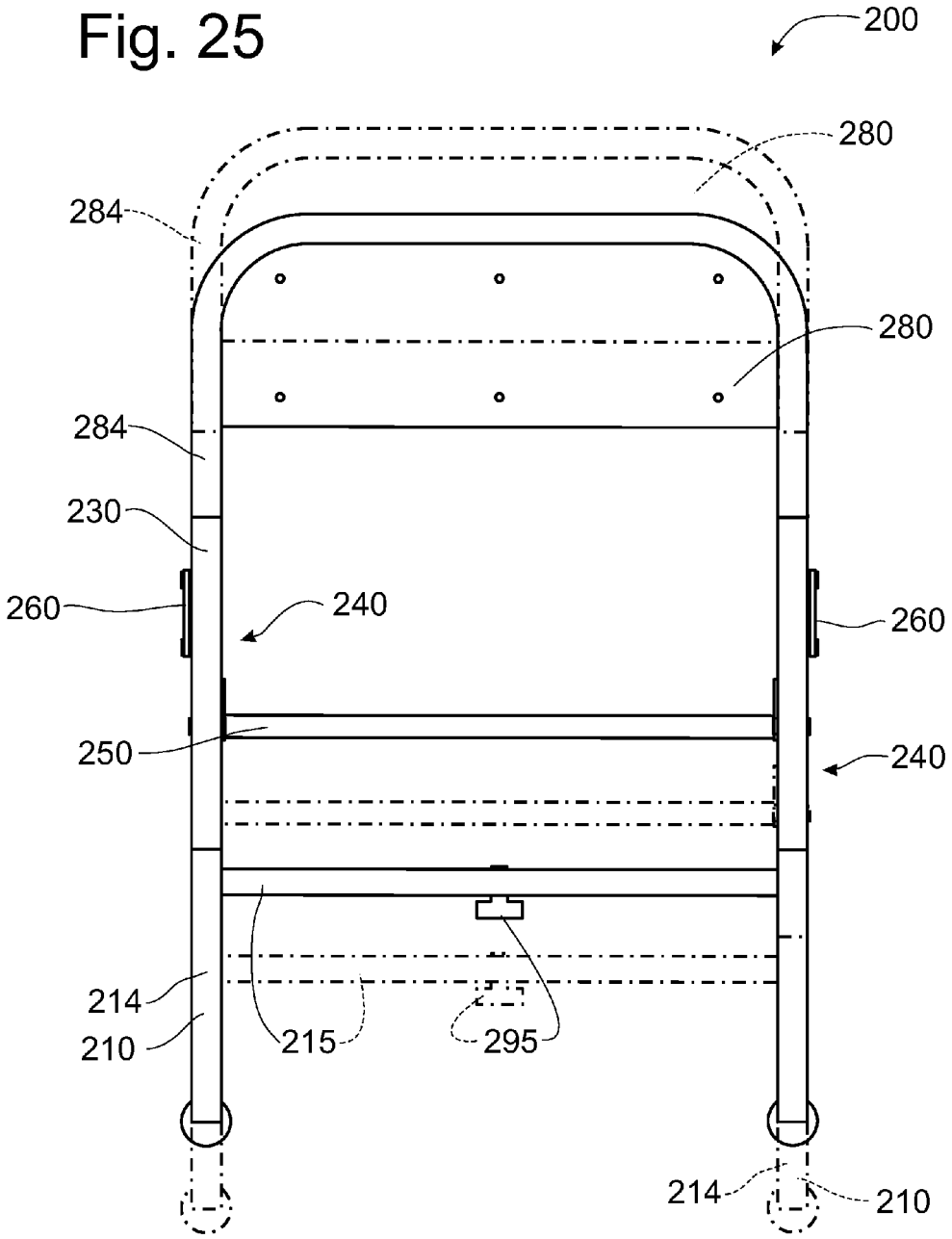
FIG. 25 is a front elevational view of the adjustable folding chair similar to that of FIG. 19, but showing the adjustable movement of the seat back portion and the adjustable leg extensions in phantom.

As can be seen in comparison of FIGS. 17-20 and FIGS. 21-23, the chair 200 is foldable into a collapsed storage configuration in a manner generally known for folding chairs 200. The linkage, including the seat 250 and the hinge link 260, allows the rear central frame member 240 to pivot against the front central frame member 230 with the seat member 250 being oriented generally vertical, and parallel to the front and rear central frame members 230, 240, as is depicted in FIGS. 21-23. In this folded, storage configuration, the chair 200 can be compactly stored or more easily transported from one location to another.

Each of the struts 215, 225 carries a locking mechanism 290 that can be operated to engage both leg members 214, 224 simultaneously for ease of operation to adjust the height of the seat member 250 above the floor on which the chair 200 is supported. As is best seen in FIGS. 26 and 27, the locking mechanism 290 includes a pair of oppositely oriented locking pins 292 mounted within the struts 215, 225 for linear movement within the corresponding strut 215, 225. Each locking pin 292 has a rounded tip 293 that projects through an opening in the corresponding leg member 214, 224 and into an aligned opening 233, 243 formed in the corresponding lower reduced diameter portions 232, 242. As can be best seen in FIG. 24, each of the lower reduced diameter portions 232, 242 is formed with a plurality of vertically spaced openings 233, 243 that are alignable with the opening in the leg member 214, 224 through which the rounded tip 293 of the locking pin 292 extends.

Each locking pin 292 is spring loaded by a biasing spring 294 captured between a washer 296, secured on the respective locking pin 292 to compress the biasing spring 295, and a block 291 within the strut 215, 225. A central actuator 295 is rotatably mounted in the strut 215, 225 for rotational movement. A cable 297 interconnects the actuator 295 and the adjacent inner ends of the locking pins 292 so that a twist (rotation) of the actuator wraps the cable 297 around the actuator 295 and draws the locking pins 292 inwardly toward the actuator 295, compressing the biasing springs 294, as is reflected in FIG. 27, by the washer 296 compressing the spring 294 inwardly against the block 291. While the locking pins 292 are withdrawn from the lower reduced diameter portions 232, 242, the front and rear leg extensions 210, 220 can be moved vertically on the lower reduced diameter portions 232, 242 to provide an effective adjustment of the length of the legs supporting the seat member 250 and selectively position the seat member 250 at the desired height above the floor.

As long as the actuator 295 is held in position corresponding to the inward displacement of the locking pins 292, the front and rear leg extensions 210, 220 can be selectively positioned on the front and rear central frame members 230, 240. Once the actuator 295 is released, the compressed spring 294 will automatically extend the locking pins 292 into engagement with the aligned openings 286 in the front and rear lower reduced diameter portions 232, 242. If the openings 286 are not exactly aligned, the biasing force from the spring 294 and the rounded surface on the tip 293 of the locking pins 292 will allow the locking pins 292 to capture the corresponding lower reduced diameter portions 232, 242 when alignment is achieved. With this actuator 295 centrally located on the corresponding strut 215, 225, the unlocking of the locking mechanisms 290 and a vertical movement of the appropriate leg extension can be accomplished with one hand by rotating the actuator 295 and using the rotated actuator 295 to cause the telescopic movement of the leg extension 210, 220 on the corresponding central frame member 230, 240. Thus, the locking mechanism 290 makes an adjustment of the chair height more easily accomplished.

Figure 27A:
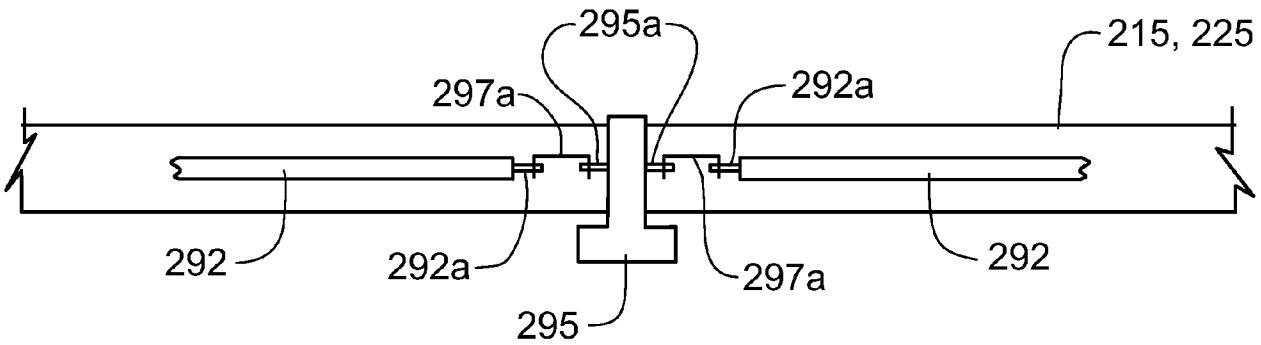
FIG. 27*a* is an enlarged partial cross-sectional view showing an elevational view of an alternative embodiment of the locking mechanism shown in FIGS. 26 and 27, the locking mechanism being depicted in the locked position, each locking pin and the support strut being broken away for purposes of clarity.
Figure 27B:
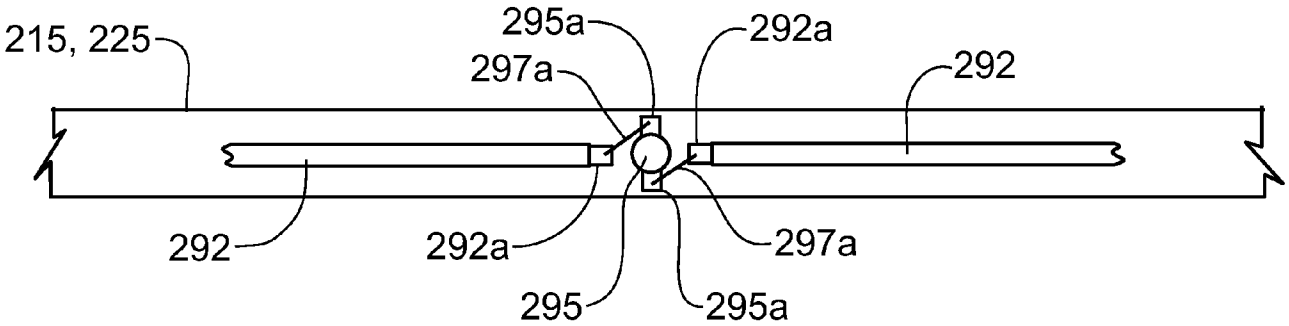
FIG. 27*b* is an enlarged partial cross-sectional view showing a top plan view of the alternative embodiment of the locking mechanism shown in FIG. 27*a*, the actuator being rotated to move the locking pins into a release orientation, each locking pin and the support strut being broken away for purposes of clarity.

An alternative embodiment of the locking mechanism shown in FIGS. 26 and 27 is shown in FIGS. 27*a* and 27*b*. Instead of cables 297 interconnecting the locking pins 292 to the actuator 295, a pair of wires 297*a* is used to transfer rotational motion of the actuator 295 to move the locking pins 292 linearly. More specifically, the actuator 295 is formed with a pair of opposing connecting tabs 295*a* that are respectively connected to flattened mounting tabs 292*a* at the innermost ends of the locking pins 292 by the wires 297*a*. As is depicted in FIG. 27*b*, the rotation of the actuator 295 moves the connecting tabs 295*a* from a transversely extending orientation to a longitudinally extending orientation. The wires 297*a* pull the respective locking pins 292 toward the actuator 295 and move the locking pins 292 into the release position. Since the locking pins 292 are guided through the blocks 291, the locking pins 292 move linearly while the wires 297*a* pivot about their respective connections with the connecting tabs 295*a* and the mounting tabs 292*a* to facilitate the transitional movement.

Looking at the alternative embodiment of the locking mechanism 290 shown in FIGS. 28 and 29, one skilled in the art will recognize that the actuators comprise an actuator pin 298 secured to the innermost end of each of the locking pins 292 in a manner to project vertically downward through corresponding slots 299 in the underside of the corresponding struts 215, 225. On the left side of FIG. 28, the locking pin 292 is engaged with the lower reduced diameter portion 232, 242 to lock the leg extension 210, 220, respectively, on the front and rear central frame members 230, 240. On the right side of FIG. 28, the locking pin 292 is shown as being retracted inwardly, compressing the biasing spring 294 as described above.

One skilled in the art will recognize that in the locked configuration, the actuator pins 298 will be located in the respective laterally outboard end of the corresponding slot 299, as is reflected in the left slot 299 in FIG. 29. The operator can then with one hand grasp the two laterally spaced actuator pins 298 and squeeze the actuator pins 298 into the inboardmost end of the slots 299, as is shown in FIG. 28 utilizing the phantom left side actuator pin 298, to effect a release of the locking mechanism 290. The corresponding leg extension 210, 220 can then be moved easily on the corresponding front or rear central frame member 23, 240 to positionally adjust the height of the seat member 250 above the floor. When the actuator pins 298 are released, the biasing springs 294 drives the locking pins 292 back into engagement with the reduced diameter portion 232, 242 through the aligned opening therein.

One skilled in the art will also recognize that the specific shapes of the respective components are a matter of design choice. For example, that leg members 214, 224 and the corresponding front and rear lower reduced diameter portions 232, 242, can be formed of square tubing, which is preferred for strength and aesthetic purposes, or from round tubing, the term "reduced diameter" being used to reflect a smaller geometric size that will be telescopically received within the leg member 214, 224.

Figure 30:
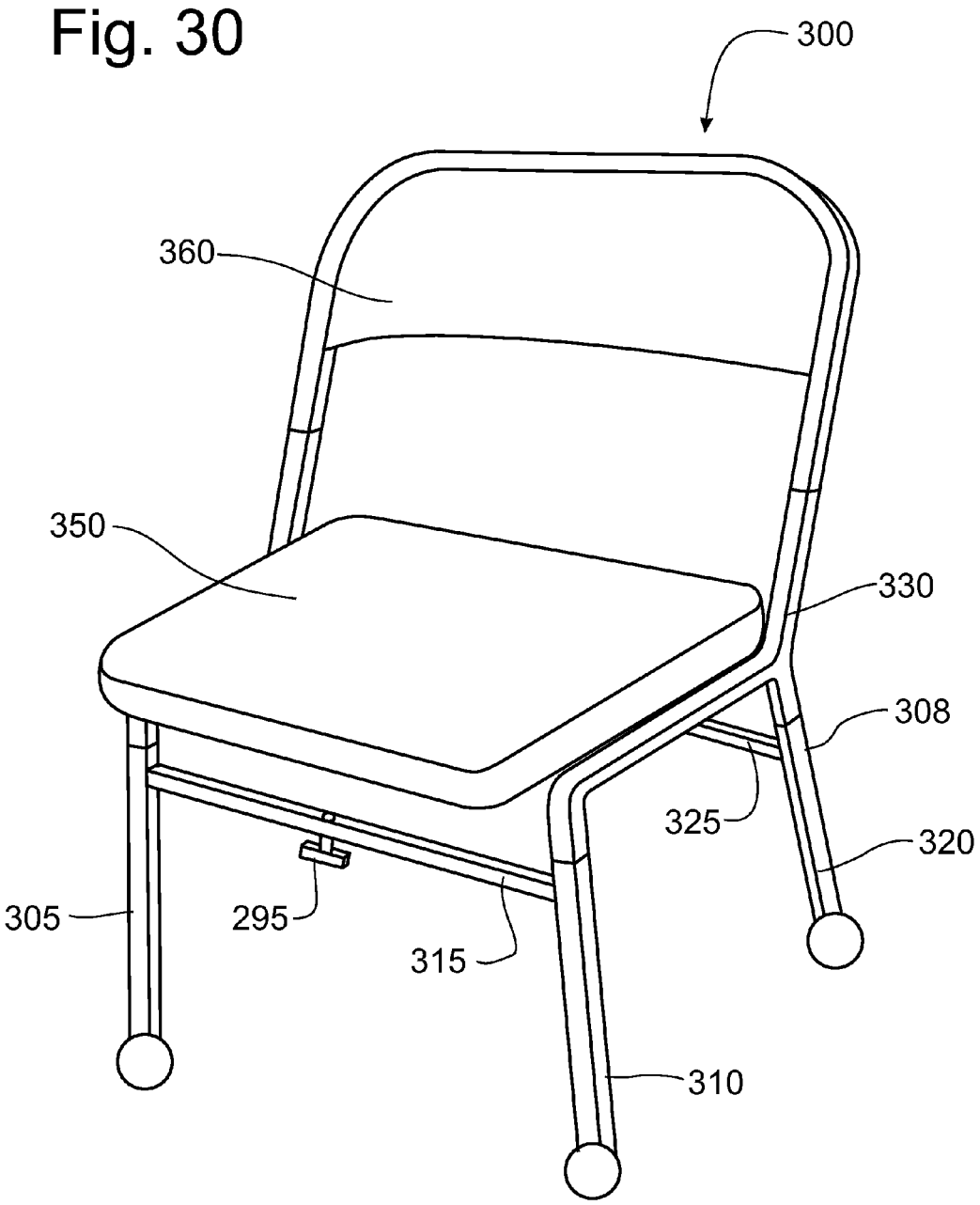
FIG. 30 is a non-folding chair incorporating the locking mechanism depicted in FIGS. 26 and 27.

Referring now to FIG. 30, a non-folding version of the adjustable height chair 300 can best be seen. The non-folding chair 300 is formed with front and rear legs 305, 308 that are oriented in a non-parallel manner, diverging downwardly, to facilitate stacking. Accordingly, the struts 315, 325 are positioned closer to the seat member 350 to also facilitate vertical stacking of chairs 300 for storage. Similarly to the adjustable folding chair 200, the chair 300 is formed with a central fixed frame member 330 that has reduced diameter portions (not shown) that are telescopically received within the front and rear leg extensions 310, 320. The locking mechanism (not shown) is housed internally of the front and rear struts 315, 325 with the actuator 295 (or alternatively 298) projecting downward from the center of the strut 315, 325 for ease of operation. The seat back 360 is similarly positionable on the central frame 330 to provide the ability to locate the seat back 360 in a desired position for comfort of the user.

The foregoing disclosure has been set forth merely to illustrate the invention and is not intended to be limiting. Since modifications to the disclosed embodiments incorporating the spirit and substance of the invention may occur to persons of ordinary skill in the art, the invention should be construed to include everything within the scope of the appended claims and equivalents thereof.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiments of the invention; however, concepts, as based upon the description, may be employed in other embodiments without departing from the scope of the invention. The invention is not otherwise limited, except for the recitation of the claims set forth below.

Having thus described the invention, what is claimed is:

1. A chair adapted to provide comfort during prolonged seating periods and facilitating proper sitting posture comprising:

a central chair portion including an outer frame member having a first dimension and inner frame members defining a pair of seat back mounting sections extending upwardly from said outer frame member, a pair of front leg mounting sections extending downwardly from said outer frame member, a pair of rear leg mounting sections extending downwardly from said outer frame member, and a seat member pivotally connected to said outer frame member, said inner frame members having a second dimension smaller than said first dimension, said seat member being positioned such that each of said seat back mounting sections, said front leg mounting sections and said rear leg mounting sections are located laterally outboard of said seat member;

a seat back including a pair of seat back extensions, each of the seat back extensions being telescopically mounted on one of the seat back mounting sections for vertical movement of said seat back relative to said seat member, said seat back extensions having said first dimension so that said seat back extensions can align with corresponding portions of said outer frame member when mounted on said seat back mounting sections;

a front leg assembly having a support strut rigidly fixed to a pair of front leg extensions telescopically mounted on the front leg mounting sections of the central chair portion to permit a height adjustment of a front edge of said seat member, said front leg extensions having said first dimension so that said front leg extensions can align with corresponding portions of said outer frame member when mounted on said front leg mounting sections;

a rear leg assembly having a support strut rigidly fixed to a pair of rear leg extensions telescopically mounted on the rear leg mounting sections of the central chair portion to permit a height adjustment of a rear edge of said seat member independently of said front edge to create a selected orientation of said seat surface, said rear leg extensions having said first dimension so that said rear leg extensions can align with corresponding portions of said outer frame member when mounted on said rear leg mounting sections;

a front locking mechanism mounted on said front leg assembly and including a front actuator operably associated with both said front leg extensions for locking the selected telescopic extension of said front leg assembly, and a rear locking mechanism mounted on said rear leg assembly and including a rear actuator operably associated with both said rear leg extensions for locking the selected telescopic extension of said rear leg assembly, wherein the seat back extensions, the front leg extensions, and the rear leg extensions are all telescopically adjustable relative to the seat member and selectively lockable in any of a plurality of discrete positions with respect to the seat member.

2. The chair of claim 1, wherein each of said front and rear locking mechanisms comprises:

a first locking pin supported for engagement with one of the corresponding said leg extensions;

a second locking pin supported for engagement with the other of the corresponding said leg extension, each said locking pin being movable between a locking position in which the locking pin engages the corresponding said leg extension and the corresponding said leg mounting section associated therewith, and a release position in which the locking pin is retracted from engagement with said corresponding leg mounting section to allow the corresponding said leg mounting section to move relative to the associated leg extension; and a spring associated with each said locking pin to bias the associated locking pin toward the locking position, the corresponding actuator being operable to move the corresponding said locking pins into the release position against the bias exerted by the corresponding spring.

3. The chair of claim 2 wherein each of said locking pins and said springs are housed within the support strut for the corresponding said leg assembly.

4. The chair of claim 3 wherein each said actuator comprises:

a rotatable knob supported on the corresponding said strut and projecting outwardly therefrom, said knob being connected to both of the associated locking pins to affect movement of both said associated locking pins simultaneously.

5. The chair of claim 4 wherein each said rotatable knob is connected to the associated locking pins by an elongated member that transfers rotational movement of the knob to retract the locking pins from engagement with the associated leg mounting sections.

6. The chair of claim 3 wherein each said actuator comprises an actuator pin positioned centrally on the corresponding said support strut and being connected to each of the associated locking pins to affect a sliding movement of the locking pin when properly manipulated, the simultaneous grasping of both said actuator pins affecting a simultaneous movement of the associated locking pins to move both said locking pins into the release position.

7. The chair of claim 3 further comprising a locking device carried by seat back mounting sections to engage the corresponding said seat back extensions to secure the selected position of the seat back relative to the seat member.

8. The chair of claim 7 wherein said locking device comprises a manually releasable spring button mechanism associated with each of the seat back mounting section that is spring-biased into locking engagement with the associated seat back extension.

9. The chair of claim 1 further comprising at least one arm rest assembly having an arm rest surface also lockable in a plurality of discrete positions relative to the seat member.

10. A folding chair comprising:

a central chair portion defining a pair of upright seat back mounting members, a pair of front leg mounting members, a pair of rear leg mounting members, and a seat member pivotally connected to the front leg mounting members and the rear leg mounting members;

a seat back including a pair of seat back extension arms telescopically mounted on the seat back mounting members and a first locking mechanism cooperable with the seat back mounting members to secure a selected telescopic position of the seat back relative to the seat member;

a front leg assembly including horizontal support strut rigidly interconnecting a pair of front leg extension arms telescopically mounted on the front leg mounting members, and a second locking mechanism cooperable with the front leg mounting members to secure the front leg assembly at a selected position relative to the seat member;

a rear leg assembly including a horizontal support strut rigidly interconnecting a pair of rear leg extension arms telescopically mounted on the rear leg mounting members, and a third locking mechanism cooperable with the rear leg mounting members to secure the rear leg assembly at a selected position relative to the seat assembly, the front leg assembly and the rear leg assembly being independently selectively positionable to locate the seat member at a selected height and at a selected front to rear orientation;

a front locking mechanism centrally mounted on the support strut on said front leg assembly and including a front actuator operably associated with both said front leg extensions for locking the selected telescopic extension of said front leg assembly, and a rear locking mechanism centrally mounted on the support strut on said rear leg assembly and including a rear actuator operably associated with both said rear leg extensions for locking the selected telescopic extension of said rear leg assembly, said front locking mechanism and said rear locking mechanism including:

a first locking pin supported within the corresponding said support strut for engagement with one of the corresponding said leg extensions;

a second locking pin supported within the corresponding said support strut in opposition to said first locking pin for engagement with the other of the corresponding said leg extension, each said locking pin being coupled to the corresponding said actuator so that said locking pins are movable between a locking position in which each said locking pin engages the corresponding said leg extension and the corresponding said leg mounting member associated therewith, and a release position in which each said locking pin is retracted from engagement with said corresponding leg mounting member to allow the corresponding said leg mounting member to move relative to the associated leg extension; and a spring associated with each said locking pin to bias the associated locking pin toward the locking position, the corresponding actuator being operable to move the corresponding said locking pins into the release position against the bias exerted by the corresponding spring, the actuator on each of the front and rear locking mechanisms being supported on an underside of the corresponding said support strut with each said spring being captured between a first stop secured on the corresponding said locking pin and a stop secured within the corresponding said support strut.

11. The folding chair of claim 10 further comprising a seat back locking mechanism carried by said seat back mounting members for selective engagement with said seat back extension arms to control the telescopic position thereof relative to the seat back mounting members.

12. The folding chair of claim 11 wherein each of the front, rear and seat back locking mechanisms are spring-biased into a locked position, each locking mechanism being selectively manually releasable to allow a repositioning of corresponding telescopically mounted members.

13. The folding chair of claim 12 wherein said seat back locking mechanism comprises a manually releasable spring button mechanism associated with each of the seat back mounting members and being spring-biased into locking engagement with the associated seat back extension arm.

14. The folding chair of claim 10 wherein each said actuator comprises:

a rotatable knob connected to both of the associated locking pins to affect movement of both said associated locking pins simultaneously, each said rotatable knob being connected to the associated locking pins by an elongated member that transfers rotational movement of the knob to retract the locking pins to retract the locking pins from engagement with the associated leg mounting members.

15. The folding chair of claim 10 wherein each said actuator comprises an actuator pin positioned centrally on the corresponding said support strut and being connected to each of the associated locking pins to affect a sliding movement of the locking pin when properly manipulated, the simultaneous grasping of both said actuator pins affecting a simultaneous movement of the associated locking pins to move both said locking pins into the release position.

16. A method of orienting a folding chair to affect proper seating of an occupant having a back, waist and legs to provide comfort for the occupant during extended periods of sitting on the chair comprising the steps of:

providing a central chair portion including an outer frame member having a first dimension and inner frame members having a second dimension smaller than said first dimension and defining a pair of seat back mounting members, a pair of front leg mounting members, and a pair of rear leg mounting members, and a seat member pivotally connected to said outer frame member;

mounting a seat back having a pair of seat back extensions telescopically into the corresponding seat back mounting members such that each of the seat back extensions is received on a corresponding one of the seat back mounting members, said seat back extensions having said first dimension so that said seat back extensions can align with corresponding portions of said outer frame member when mounted on said seat back mounting members;

positioning the seat back relative to the seat member by telescopically moving the seat back extensions relative to the seat back mounting members to locate the seat back at a selected seat back position wherein a lower ledge of the seat back is located above the waist of the occupant;

securing the seat back in the selected seat back position;

telescopically mounting a front leg assembly having a pair of front leg extensions and a horizontal strut interconnecting the front leg extensions onto the corresponding front leg mounting members of the central chair portion, said front leg extensions having said first dimension so that said front leg extensions can align with corresponding portions of said outer frame member when mounted on said front leg mounting members;

telescopically mounting a rear leg assembly having a pair of rear leg extensions and a horizontal strut interconnecting the rear leg extensions onto the corresponding rear leg mounting members of the central chair portion, said rear leg extensions having said first dimension so that said rear leg extensions can align with corresponding portions of said outer frame member when mounted on said rear leg mounting members;

adjusting the front leg assembly and the rear leg assembly by telescopically locating the front leg extensions and the rear leg extensions relative to the corresponding front leg mounting members and the rear leg mounting members, respectively, to create a selected height of the seat member to correspond to the legs of the occupant and a selected front to rear orientation of the seat member; and locking the front leg extensions and the rear leg extensions on the corresponding front leg mounting sections and the rear leg mounting sections by a locking mechanism carried within the support strut in each of said front leg assembly and rear leg assembly, respectively, to secure the seat member at the selected height and orientation, each said locking mechanism including:

a centrally positioned actuator mounted on each respective horizontal strut;

a first locking pin supported within the corresponding said horizontal strut for engagement with one of the corresponding said leg extensions;

a second locking pin supported within the corresponding said horizontal strut in opposition to said first locking pin for engagement with the other of the corresponding said leg extensions, each said locking pin being coupled to the corresponding said actuator so that said locking pins are movable between a locking position in which each said locking pin engages the corresponding said leg extension and the corresponding said leg mounting member associated therewith, and a release position in which each said locking pin is retracted from engagement with said corresponding leg mounting member to allow the corresponding said leg mounting member to move relative to the associated leg extension; and a spring associated with each said locking pin to bias the associated locking pin toward the locking position, the corresponding actuator being operable to move the corresponding said locking pins simultaneously into the release position against the bias exerted by the corresponding spring by manipulation of the centrally positioned actuator.

17. The method of claim 16 wherein said adjusting step includes the steps of:

releasing a front locking mechanism securing a telescopic position of the front leg extensions relative to the front leg mounting members by manipulating a front actuator to retract the corresponding said locking pins simultaneously from the front leg extensions and utilizing the front actuator to move the front leg assembly while holding the front actuator to retract said locking pins;

releasing a rear locking mechanism securing a telescopic position of the rear leg extensions relative to the rear leg mounting members by manipulating a rear actuator to retract the corresponding said locking pins simultaneously from the rear leg extensions and utilizing the rear actuator to move the rear leg assembly while holding the front actuator to retract said locking pins.

18. The method of claim 17 wherein said locking step includes the step of releasing the front and rear actuators to allow said spring-biased locking pins to return to said locking positions that secures the front leg extensions to the front leg mounting members and the rear leg extensions to the rear leg mounting members, after the selected height and the selected front to rear orientation of the seat member has been attained.

* * * * *